US007144695B2

(12) United States Patent
Oyamada

(10) Patent No.: US 7,144,695 B2
(45) Date of Patent: Dec. 5, 2006

(54) PHOTOTHERMOGRAPHIC MATERIAL

(75) Inventor: Takayoshi Oyamada, Kanagawa (JP)

(73) Assignee: Fuji Photo Film Co., Ltd., Tokyo (JP)

( * ) Notice: Subject to any disclaimer, the term of this patent is extended or adjusted under 35 U.S.C. 154(b) by 0 days.

(21) Appl. No.: 10/453,634

(22) Filed: Jun. 4, 2003

(65) Prior Publication Data

US 2003/0232294 A1 Dec. 18, 2003

(30) Foreign Application Priority Data

Jun. 10, 2002 (JP) ..... 2002-168852

(51) Int. Cl.
*G03C 1/498* (2006.01)
*G03C 1/38* (2006.01)

(52) U.S. Cl. ..... 430/620; 430/607; 430/619; 430/631; 430/935

(58) Field of Classification Search ..... 430/620, 430/619, 631, 607, 523, 935
See application file for complete search history.

(56) References Cited

U.S. PATENT DOCUMENTS 4,152,160 A * 5/1979 Ikienoue et al. ..... 430/495.1
6,458,525 B1 * 10/2002 Takiguchi et al. ..... 430/617
6,645,704 B1 * 11/2003 Levy ..... 430/349

FOREIGN PATENT DOCUMENTS

EP 1096310 * 5/2001
JP 11-271920 * 10/1999
JP A 2002-55405 2/2000

* cited by examiner

*Primary Examiner*—Thorl Chea
(74) *Attorney, Agent, or Firm*—Margaret A. Burke; Sheldon J. Moss

(57) ABSTRACT

The invention relates to a photothermographic material, comprising a photosensitive silver halide, a non-photosensitive organic silver salt, a reducing agent, and a binder on a same surface of a support, wherein the non-photosensitive organic silver salt is the non-photosensitive organic silver salt in a dispersion that has been subjected to an annealing treatment at 30° C. or more.

17 Claims, 3 Drawing Sheets

PHOTOTHERMOGRAPHIC MATERIAL

CROSS-REFERENCE TO RELATED APPLICATION

This application claims priority under 35 USC 119 from Japanese Patent Application No. 2002-168852, the disclosure of which is incorporated by reference herein.

BACKGROUND OF THE INVENTION

1. Field of the Invention

The present invention relates to photothermographic materials. In particular, the invention pertains to a photothermographic material which is water-base coated.

2. Description of the Related Art

In recent years, reduction of a quantity of a waste processing solution is strongly desired in the field of medical diagnosis from the standpoints of preservation of the environment and space saving. Therefore, a technique relating to a photothermographic material, for use in the medical diagnosis and a photographic art, which is capable of being efficiently exposed with a laser image setter or a laser imager and forming a clear black image having high resolution and sharpness, is required. The photothermographic material can provide users with a simple and non-polluting thermal development processing system that eliminates the use of solution type processing chemicals.

It is characteristic of an image for use in the medical diagnosis that, a high image quality excellent in sharpness and graininess is necessary due to a requirement for a fine depiction thereon and thus, a cold monochromatic image is preferred from the viewpoint of the ease of diagnosis. At present, various types of hard copy systems utilizing a pigment or a dye, such as an ink jet printer and an electronic photographic system, are distributed as an general image forming system. However, none of the hard copy systems is satisfactory as an output system of the image for use in the medical use.

Meanwhile, photothermographic systems utilizing an organic silver salt are described in, for example, U.S. Pat. Nos. 3,152,904 and 3,457,075 and B. Shelly, "Thermally Prossessed Silver Systems" (Imaging Prossesses and Materials, Neblette, 8th Ed. compiled by J. Sturge, V. Walworth and A. Shepp, p. 2, 1996).

In particular, the photothermographic material comprises a photosensitive layer in which a catalytically active quantity of photocatalyst (for example, silver halide), a reducing agent, a reducible silver salt (for example, organic silver salt) and, optionally, a color toning agent for controlling color tone of silver are ordinarily dispersed in a binder matrix. When the photothermographic material is heated at a high temperature (for example, 80° C. or more) after being exposed imagewise, a monochromatic black silver image is produced by an redox reaction between the silver halide or the reducible silver salt (functioning as an oxidizing agent) and the reducing agent. The redox reaction is accelerated by a catalytic action of a latent image of the silver halide generated by such exposure. Therefore, the black silver images are formed in exposed areas of the material. This technique is disclosed in many references including U.S. Pat. No. 2,910,377 and JP-B No. 43-4924. Then, Fuji Medical Dry Imager FM-DP L was put into the market as an image forming system for medical diagnosis utilizing the photothermographic material.

In manufacturing of the photothermographic system utilizing the organic silver salt, the system has been produced so far by a coating with an organic solvent. Examples of such organic solvents include methyl ethyl ketone (MEK), toluene, and acetone. When the solvents were coated and dried, a post-treatment, such as recovering or drying, was necessary for preventing diffusion of the solvents into air, which caused enlargement of production facilities and increase in production cost. Further, there was a problem that the solvents remained in products and, when the products were handled, particularly at a thermal development, the solvents evaporated from a film thereof to emit a odor, or diffused into the environment to pollute it. In recent years, a water-base coating type photothermographic material which is produced by coating and drying a coating solution that contains various types of components in a dispersed state and polymer fine particles as a binder in a form of an aqueous dispersion, has been developed. Then, Fuji Medical Dry Imager FM-DP L was put into the market as an image forming system for medical diagnosis utilizing such system as described above. Since the latter system is capable of using high-speed type facilities for coating and drying of the emulsion common to production of a conventional wet-type photosensitive material and performing production by a high-speed wide coating, it is advantageous in mass-production.

The organic silver salt has ordinarily been dispersed in an organic solvent and used so far. However, in case of the water-base coating type photothermographic material. it is necessary to disperse finely the organic silver salt in water. Particularly, in order to exhibit transparency of a coated film, a uniformly coated surface state, and a stable photographic performance, it is necessary to use the organic silver salt dispersed finely and uniformly. For such dispersion, a media dispersion (ball mill, sand grinder mill or the like) using balls, such as those of iron, zirconia, and glass, as dispersion media has ordinarily been utilized.

However, when the organic silver salt is dispersed in water, it has been found that shelf-stability, fogging and the like of the photothermographic material are substantially affected by condition of such dispersion. In other words, as the dispersion becomes finer, uniformity of a coated film of the photothermographic material produced by coating such dispersion is improved and speeding-up of development can also be aimed, but an adverse effect has been found at the same time that, the fogging is increased and the shelf-stability is deteriorated.

It is conventionally known that a solid fine particle dispersion of an organic compound is subjected to an annealing treatment. It is described in, for example, Japanese Patent Application Laid-Open (JP-A) Nos. 5-216166, 5-313307 and 8-201975 that a spectral absorption spectrum of a dye is adjusted or dispersion stability thereof is improved by subjecting a dye solid dispersion to the annealing treatment. Further, it is described in, for example, JP-A No. 2002-55405 that a dispersion of a bisphenol compound, which is a reducing agent used in the photothermographic material, a polyhalogen compound as an antifoggant, and a compound capable of forming a hydrogen bond with the bisphenol compound is subjected to the annealing treatment for trying to improve a sedimentation stability of the dispersion, or stability of the dispersion against agglomeration thereof during storage.

However, it can not be anticipated from these descriptions that the annealing treatment of the organic silver salt is connected with solution of the problem recited in the present invention.

SUMMARY OF THE INVENTION

Therefore, an object of the present invention is to provide a photothermographic material in which the fogging is low, and the shelf-stability is excellent by using an improved dispersion of an organic silver salt. Particularly, the object of the invention is to provide an water-base coating type photothermographic material in which the fogging is low and the shelf-stability is excellent by using an improved aqueous dispersion of the silver salt.

The object of the invention has been achieved by a photothermographic material described in the following.

(1) A photothermographic material, comprising a photosensitive silver halide, a non-photosensitive organic silver salt, a reducing agent, and a binder on a same surface of a support, further comprising a dispersion which comprises the non-photosensitive organic silver salt and has been subjected to an annealing treatment at a temperature of 30° C. or more.

(2) The photothermographic material described in (1) above, wherein the organic silver salt is an organic silver salt which has been dispersed and prepared by a high-pressure homogenizer.

(3) The photothermographic material described in (1) and (2) above, wherein the annealing treatment is performed at a temperature of from 30° C. to less than 90° C. for from 0.1 hour to 30 days.

(4) The photothermographic material described in (1) to (3) above, wherein the organic silver salt contains from 50% by mol to 100% by mol of silver behenate.

(5) The photothermographic material described in (4) above, wherein the organic silver salt contains from 90% by mol to 100% by mol of silver behenate.

(6) The photothermographic material described in (5) above, wherein the organic silver salt contains from 95% by mol to 100% by mol of silver behenate.

The first aspect of the invention is a photothermographic material (S), comprising a photosensitive silver halide, a non-photosensitive organic silver salt, a reducing agent and a binder on a same surface of a support, and further comprising a dispersion which is obtained by subjecting a dispersion of the non-photosensitive organic silver salt to an annealing treatment at a temperature of 30° C. or higher.

The second aspect of the invention is the photothermographic material (S), wherein the annealing treatment is performed at a temperature of 30° C. to 90° C.

The third aspect of the invention is the photothermographic material (S), wherein the annealing treatment is performed for a period of 0.1 hour to 30 days.

The fourth aspect of the invention is the photothermographic material (S), wherein the non-photosensitive organic silver salt dispersion is put in a container, which is then hermetically sealed, and subjected to the annealing treatment such that the thus-hermetically sealed container is stored in a storage vault which is kept at 30° C. or more while a quantity of air and an area of interface between vapor and liquid phases therein are minimized.

The fifth aspect of the invention is the photothermographic material (S), wherein the annealing treatment is performed such that the non-photosensitive organic silver salt dispersion is kept at a temperature that is 30° C. or higher and higher than a dispersion temperature of the non-photosensitive organic silver salt dispersion, while the non-photosensitive organic silver salt dispersion is stirred.

The sixth aspect of the invention is the photothermographic material (S), wherein the non-photosensitive organic silver salt contains from 50% by mol to 100% by mol of silver behenate.

The seventh aspect of the invention is the photothermographic material (S), wherein the non-photosensitive organic silver salt is a silver salt of a long-chain aliphatic carboxylic acid having from 10 to 30 carbon atoms.

The eighth aspect of the invention is the photothermographic material (S), wherein a particle size distribution of the non-photosensitive organic silver salt is a mono-dispersion.

The ninth aspect of the invention is the photothermographic material (S), wherein the non-photosensitive organic silver salt is a non-photosensitive organic silver salt which has been dispersed and prepared by a high-pressure homogenizer.

The tenth aspect of the invention is the photothermographic material (S), wherein, at the time of dispersing the non-photosensitive organic silver salt, the photosensitive silver halide is present in an amount of 1% by mol or less, based on 1 mol of the non-photosensitive organic silver salt.

The eleventh aspect of the invention is the photothermographic material (S), wherein a developing accelerator is contained in an amount of 0.1% by mol to 20% by mol, based on an amount of the reducing agent.

The twelfth aspect of the invention is the photothermographic material (S), wherein a pH of a film surface thereof before being subjected to thermal developing treatment is 7.0 or less.

The thirteenth aspect of the photothermographic material (S), further comprising a fluorine-type surfactant.

The fourteenth aspect of the invention is the photothermographic material (S), further comprising a compound represented by the following formula (H) as an antifoggant:

$$Q\text{-}(Y)_n\text{—}C(Z_1)(Z_2)X \qquad \text{formula (H)}$$

wherein Q represents at least one group selected from the group consisting of an alkyl group, an aryl group, and a heterocyclic group; Y represents a divalent linking group; n represents 0 or 1; $Z_1$ and $Z_2$ each independently represent a halogen atom; and X represents a hydrogen atom or an electron-attracting group.

The fifteenth aspect of the invention is the photothermographic material (S), wherein the reducing agent is a compound represented by the following formula (R):

Fomula (R)

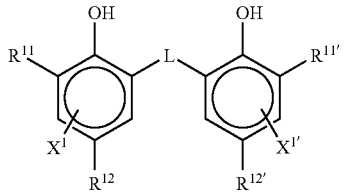

wherein $R^{11}$ and $R^{11'}$ each independently represent an alkyl group having from 1 to 20 carbon atoms; $R^{12}$ and $R^{12'}$ each independently represent a hydrogen atom or a substituent which can be substituted by a benzene ring; L represents —S— or $CHR^{13}$—, in which $R^{13}$ represents a hydrogen atom or an alkyl group having from 1 to 20 carbon atoms; and $X^1$ and $X^{1'}$ each independently represent a hydrogen atom or a group which can be substituted by a benzene ring.

The sixteenth aspect of the invention is the photothermographic material (S) further comprising a non-reducible compound having a group which can form a hydrogen bond with an aromatic hydroxyl group of the reducing agent, wherein the reducing agent is a compound represented by the formula (R).

The seventeenth aspect of the invention is the photothermographic material (S), comprising an image forming layer comprising the photosensitive silver halide, the non-photosensitive organic silver salt, the reducing agent, and the binder.

The eighteenth aspect of the invention is the photothermographic material (S), comprising an image forming layer comprising the photosensitive silver halide, the non-photosensitive organic silver salt, the reducing agent, and the binder, further comprising a surface protection layer on the image forming layer.

The nineteenth aspect of the invention is the photothermographic material (S), comprising an image forming layer comprising the photosensitive silver halide, the non-photosensitive organic silver salt, the reducing agent, and the binder, further comprising a back layer on a surface of the support opposite to the image forming layer.

The twentieth aspect of the invention is the photothermographic material (S), comprising an image forming layer comprising the photosensitive silver halide, the non-photosensitive organic silver salt, the reducing agent, and the binder, wherein a total amount of silver in the photosensitive silver halide and the non-photosensitive organic silver salt in the image forming layer is in a range of 0.1 $g/m^2$ to 5.0 $g/m^2$.

DETAILED DESCRIPTION OF THE INVENTION

Figure 1:
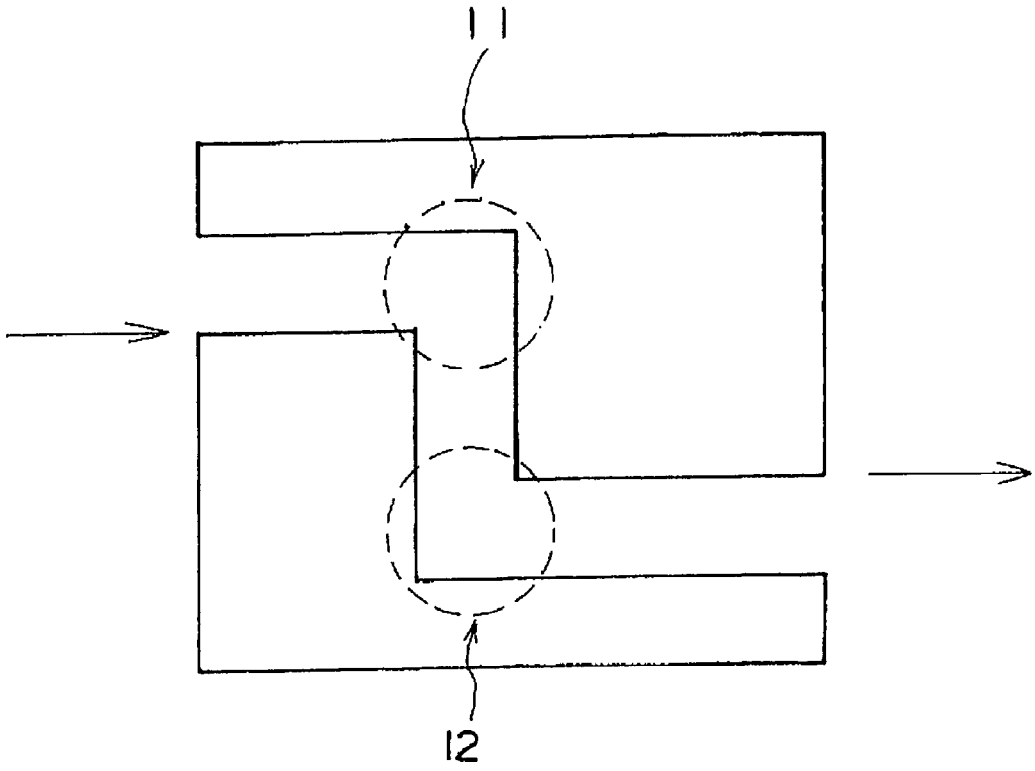
FIG. 1 is a diagram explaining a high-pressure crushing part of a dispersion apparatus comprising the high-pressure crushing part according to the present invention.

Hereinafter, the present invention will be described in detail.

A photothermographic material according to the invention comprises an image forming layer comprising a photosensitive silver halide, a non-photosensitive organic silver salt, a reducing agent, and a binder on at least one surface of a support and may, optionally, comprise a surface protection layer on the image forming layer, or a back layer or a back protection layer on a surface opposite to the image forming layer.

The image forming layer, the surface protection layer, the back layer, the back protection layer and the like may each be composed of a mono-layer or a multi-layer.

A constitution and preferable components of each layer thereof will be described in detail.

1. Image Forming Layer

1-1. Photosensitive Silver Halide

1) Composition of Silver Halide

A halogen composition of a photosensitive silver halide according to the invention is not particularly limited whereupon silver chloride, silver chlorobromide, silver bromide, silver iodobromide, silver iodochlorobromide and silver iodide can be used. Among these halides, silver bromide, silver iodobromide, and silver iodide are preferable. A distribution of the halogen composition in a grain may be uniform, or changing stepwise or continuously within a grain. Further, a silver halide grain having a core/shell structure can also preferably be used. As for a structure thereof, a twofold to fivefold structure is preferable. A core/shell grain having a twofold to fourfold structure can more preferably be used. Still further, a technique of localizing silver bromide, or silver iodide on a surface of a grain of silver chloride, silver bromide or silver chlorobromide can also preferably be used.

2) Method of Forming Grain

A method of forming the photosensitive silver halide is well known to those in the art. For example, methods described in Research Disclosure No. 17029, June, 1978 and U.S. Pat. No. 3,700,458 can be used. Specifically, used is a method in which the photosensitive silver halide is prepared by adding a silver-supplying compound and a halogen-supplying compound to a solution containing gelatin or any one of other polymers and, then, an organic silver salt is added to the thus-prepared photosensitive silver halide. Further, methods described in paragraphs [0217] to [0224] of JP-A No. 11-119374, and JP-A Nos. 11-352627 and 2000-347335 are also preferable.

3) Grain Size

A grain size of the photosensitive silver halide is preferably small for the purpose of suppressing white turbidity thereof to be generated after an image is formed therein. Specifically, the grain size thereof is preferably 0.20 μm or less, more preferably in the range of from 0.01 μm to 0.15 μm and still more preferably in the range of from 0.02 μm to 0.12 μm. The term "grain size" as used herein represents a diameter of a circle having the same area as the area of the projection of the silver halide grain (a projection area of a main plane in case of a tabular grain).

4) Grain Shape

As for the shapes of the silver halide grains, cubic, octahedral, tabular, spherical, rod-like and potato-like grains can be cited. According to the invention, a cubic grain is particularly preferable. The silver halide grain having a rounded corner is also preferably used. Although no particular limitation is imposed on face indices (Miller indices) of an outer surface of the photosensitive silver halide grain, the silver halide grain preferably has a high proportion of {100} face featuring high spectral sensitization efficiency upon adsorption of a spectral sensitizing dye. The proportion of {100} face is preferably 50% or more, more preferably 65% or more and still more preferably 80% or more. The proportion of Miller index {100} face can be determined by the method described in T. Tani, J. Imaging Sci., 29, 165 (1985), utilizing adsorption dependency of {111} face and {100} face upon adsorption of a sensitizing dye.

5) Heavy Metal

The photosensitive silver halide grain according to the invention may contain a metal or a metal complex belonging to the groups 8 to 10 in the periodical table (showing the groups 1 to 18). As for the metal or the central metal in the metal complex belonging to the groups 8 to 10 in the periodical table, rhodium, ruthenium, and iridium are preferable. These metal complexes may be used singly, or two or more types of complexes having a same metal or different metals can be used simultaneously in combination. A preferable content ratio of these metals or metal complexes is, per 1 mol of silver, in the range of from $1\times10^{-9}$ mol to $1\times10^{-3}$ mol. These heavy metals, metal complexes and addition methods thereof are described in JP-A No. 7-225449, paragraphs [0018] to [0024] of JP-A No. 11-65021, and paragraphs [0227] to [0240] of JP-A No. 11-119374.

According to the invention, the silver halide grain having a hexacyano metal complex on an outermost surface thereof is preferable. Examples of such hexacyano metal complexes include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. According to the invention, the hexacyano Fe complex is preferable.

Although a counter cation of the hexacyano metal complex is not important because the hexacyano metal complex exists in an ionic form in an aqueous solution. It is preferable to use an alkali metal ion such as a sodium ion, a potassium ion, a rubidium ion, a cesium ion or a lithium ion; an ammonium ion; and an alkyl ammonium ion (for example, a tetramethyl ammonium ion, a tetraethyl ammonium ion, a tetrapropyl ammonium ion or a tetra (n-butyl) ammonium ion), which can be mixed with water easily and appropriate for a precipitation operation of a silver halide emulsion.

The hexacyano metal complex can be mixed with water, a mixed solvent of water and an appropriate organic solvent mixable with water (for example, alcohols, ethers, glycols, ketones, esters, and amides), or gelatin and, then, added.

A quantity of the hexacyano metal complex to be added is, per 1 mol of silver, preferably in the range of from $1\times10^{-5}$ mol to $1\times10^{-2}$ mol and more preferably in the range of from $1\times10^{-4}$ mol to $1\times10^{-3}$ mol.

In order to allow the hexacyano metal complex to be present on the outermost surface of the silver halide grain, the hexacyano metal complex is directly added in any stage of the following, which is within a period from completion of the addition of an aqueous silver nitrate solution to be used for grain formation, to before the chemical sensitization step in which chalcogen sensitization such as sulfur sensitization, selenium sensitization or tellurium sensitization, or precious metal sensitization such as gold sensitization is performed. That is, the any stage of; before a loading step; during a water-washing step; during a dispersion step; and before the chemical sensitization step. To inhibit the growth of the silver halide grain, the hexacyano metal complex is preferably added immediately after the grain formation and, accordingly, preferably before completion of the loading step.

Further, the addition of the hexacyano metal complex may be started after 96% by mass of an entire quantity of silver nitrate to be added for the grain formation is added, preferably started after 98% by mass thereof is added, and more preferably started after 99% by mass thereof is added.

When any of these hexacyano metal complexes is added after the addition of the aqueous silver nitrate solution which is performed immediately before grain formation is completed, the hexacyano metal complex can be adsorbed on the outermost surface of the silver halide grain whereupon most of such hexacyano metal complexes each form an insoluble salt with a silver ion on a grain surface. Since a silver salt of hexacyano Fe (II) is a more insoluble than AgI, it can prevent re-dissolution of fine grains. As a result, it has become possible to manufacture a silver halide fine grain having a small grain size.

Other metal atoms that can be contained in the silver halide grain according to the invention, a desalting method and a chemical sensitization method of the silver halide emulsion are described in paragraphs [0046] to [0050] of JP-A No. 11-84574, paragraphs [0025] to [0031] of JP-A No. 11-65021, and paragraphs [00242] to [0250] of JP-A No. 11-119374.

6) Gelatin

Various types of gelatin can be used as gelatin to be contained in the photosensitive silver halide emulsion according to the invention. For the necessity of maintaining an excellent dispersion state of the photosensitive silver halide emulsion in a coating solution containing an organic silver salt, it is preferable to use a gelatin having a molecular weight in the range of from 10,000 to 1,000,000. Further, it is preferable to subject a substituent of the gelatin to a phthalization treatment. The gelatin may be used at a grain formation or at dispersing after a desalting treatment is performed. They are preferably used at grain formation.

7) Sensitizing Dyes

As for sensitizing dyes applicable to the invention, a sensitizing dye capable of spectrally sensitizing the silver halide grain at a desired wavelength when adsorbed on the silver halide grain and having spectral sensitivity appropriate to spectral characteristics of an exposure light source can advantageously be selected. The sensitizing dyes and addition methods thereof are described in paragraphs [0103] to [0109] of JP-A No. 11-65021, as compounds represented by the general formula (II) in JP-A No. 10-186572, as dyes represented by the general formula (I) in JP-A No. 11-119374, in paragraph [0106] of JP-A No. 11-119374, U.S. Pat. No. 5,510,236, as dyes mentioned in Example 5 in U.S. Pat. No. 3,871,887, in JP-A No. 2-96131, as dyes disclosed in JP-A No. 59-48753, in pp. 19 (line 38) to 20 (line 35) of European Patent Application Laid-Open (EP-A) No. 0803764, JP-A Nos. 2001-272747, 2001-290238, 2002-23306 and the like. These sensitizing dyes may be used alone or in combination of them. The sensitizing dye is added to the silver halide emulsion according to the invention preferably within a period from the completion of a desalting step to the start of a coating step, and more preferably from the completion of the desalting step to the completion of the chemical ripening.

The addition amount of the sensitizing dye according to the invention may be a desired amount in accordance with the sensitivity or the fogging performance. The addition amount is preferably in the range of from $1\times10^{-6}$ mol to 1 mol and more preferably in the range of from $1\times10^{-4}$ mol to $1\times10^{-1}$ mol, per 1 mol of silver halide in the photosensitive layer.

According to the invention, in order to enhance spectral sensitizing efficiency, a super-sensitizer can be used. As for the super-sensitizers, mentioned are compounds described in, for example, EP-A No. 587,338, U.S. Pat. Nos. 3,877,943 and 4,873,184, JP-A Nos. 5-341432, 11-109547 and 10-111543.

8) Chemical Sensitization

It is preferable that the photosensitive silver halide grain according to the invention is chemically sensitized by a sulfur sensitization method, a selenium sensitization method or a tellurium sensitization method. As for compounds preferably used in the sulfur sensitization method, the selenium sensitization method or the tellurium sensitization method, known compounds, for example, such compounds as described in JP-A No. 7-128768 can be used. Particularly, according to the invention, the tellurium sensitization is preferable, and compounds described in the references cited in paragraph [0030] of JP-A No. 11-65021 and compounds represented by the general formulae (II), (III) and (IV) of JP-A No. 5-313284 are more preferable.

It is preferable that the photosensitive silver halide grain according to the invention may be chemically sensitized by gold sensitization singly or in combination with the chalcogen sensitization. It is preferable that a gold sensitizing agent has an oxidation number of gold of either 1 or 3. A gold compound which is ordinarily used is preferable as the gold sensitizing agent. Specific examples of preferable gold sensitizing agents include chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold. The gold sensitizing agents described in U.S. Pat. No. 5,858,637 and JP-A No. 2002-278016 are also favorably used.

According to the invention, the chemical sensitization can be performed at any time within a period from the completion of the grain formation to the start of the coating. For example, after the desalting, a period of (1) before spectral sensitization, (2) simultaneously with spectral sensitization, (3) after spectral sensitization or (4) immediately before coating, is possible.

An use amount of the sulfur, selenium or tellulium sensitizing agent used according to the invention, varies depending on the silver halide grain used, a chemical ripening condition and the like. The use amount is approximately in the range of from $1\times10^{-8}$ mol to $1\times10^{-2}$ mol and preferably in the range of from $1\times10^{-7}$ mol to $1\times10^{-1}$ mol, per 1 mol of silver halide.

The addition amount of the gold sensitizing agent is, though varying depending on various conditions. The standard amount of addition is approximately in the range of from $1\times10^{-7}$ mol to $1\times10^{-3}$ mol and more preferably $1\times10^{-6}$ mol to $5\times10^{-4}$ mol, per 1 mol of silver halide.

Conditions of chemical sensitization according to the invention are not particularly limited. Approximately, the pH can be from 5 to 8, the pAg can be from 6 to 11 and the temperature can be from 40° C. to 95° C.

A thiosulfonic acid compound may be added to the silver halide emulsion recited in the invention by a method described in EP-A No. 293,917.

It is preferable that the photosensitive silver halide grain recited in the invention is treated with a reducing agent. As for specific compounds used in a reduction sensitization method, ascorbic acid and thiourea dioxide are preferable; as for other compounds, stannous chloride, aminoiminomethane sulfinic acid, a hydrazine derivative, a borane compound, a silane compound and a polyamine compound can preferably be used. A reduction sensitizing agent may be added at any stage of a photosensitive emulsion production step from the step of crystal growth to the preparation step immediately before the coating. Further, it is preferable that the reduction sensitization is performed by ripening the grains while keeping the emulsion at pH of 7 or more, or at pAg of 8.3 or less. It is also preferable that the reduction sensitization is performed by introducing a single addition portion of silver ion during the formation of the grains.

It is preferable that the photosensitive silver halide emulsion according to the invention comprises an FED sensitizer (Fragmentable electron donating sensitizer) as a compound which generates two electrons by one photon. As for such FED sensitizers, compounds described in U.S. Pat. Nos. 5,747,235, 5,747,236, 6,054,260, and 5,994,051, and JP-A No. 2002-287293 are preferable. As for steps in which the FED sensitizer is added, any step in a manufacturing process of a photosensitive emulsion within steps from the crystal growth to immediately before the coating, is preferable. The addition amount is, though varying depending on various types of conditions, as an approximate standard, preferably from $1\times10^{-7}$ mol to $1\times10^{-1}$ mol and more preferably from $1\times10^{-6}$ mol to $5\times10^{-2}$ mol, per 1 mol of silver halide.

9) Combination Usage of a Plurality of Silver Halides

In the photothermographic material according to the invention, a single type of photosensitive silver halide emulsion may be used, or two or more types of silver halide emulsions (for example, those having different average grain sizes, different halogen compositions, different crystal habits or different chemical sensitization conditions from one another) may be used in combination. Using plural types of photosensitive silver halides having different extents of sensitivity from one another enables the adjustment of the gradation. Related technologies are described in, for example, JP-A Nos. 57-119341, 53-106125, 47-3929, 48-55730, 46-5187, 50-73627 and 57-150841. Difference in sensitivity among individual emulsions is preferably 0.2logE or larger.

10) Coating Amount

The addition amount of the photosensitive silver halide grain is, in terms of the amount of coated silver per 1 $m^2$ of the photosensitive material, preferably in the range of from 0.03 $g/m^2$ to 0.6 $g/m^2$, more preferably in the range of from 0.05 $g/m^2$ to 0.4 $g/m^2$ and most preferably in the range of from 0.07 $g/m^2$ to 0.3 $g/m^2$. Further, the addition amount of the photosensitive silver halide grain is, per 1 mol of the organic silver salt, preferably in the range of from 0.01 mol to 0.5 mol, more preferably in the range of from 0.02 mol to 0.3 mol and still more preferably in the range of from 0.03 mol to 0.2 mol.

11) Method for Mixing Photosensitive Silver Halide and Organic Silver Salt

Regarding the method and the condition for mixing the photosensitive silver halide and the organic silver salt which have separately been prepared, a method in which the thus-prepared silver halide grains and the organic silver salt are mixed by using a high-speed stirrer, a ball mill, a sand mill, a colloid mill, a vibration mill or a homogenizer, a method in which the photosensitive silver halide which has been prepared is added to the organic silver salt at any desired time during the preparation of the organic silver salt, or the like can be employed. However, the method and the condition are not limited, so long as an effect recited in the invention can be sufficiently obtained. Further, mixing two or more types of aqueous dispersions of organic silver salts and two or more types of aqueous dispersions of photosensitive silver salts is an advantageous method for adjusting photographic characteristics.

A preferable time at which the silver halide according to the invention is added to a coating solution for an image forming layer may be during a period from 180 minutes before the coating to immediately before the completion of the coating, and preferably from 60 minutes before the coating to 10 seconds before the completion of the coating.

However, a method and a condition of such addition is not particularly limited, so far as an effect recited in the invention can be sufficiently obtained. Specific mixing methods include, for example, a method of mixing in a tank such that an average retention time, as calculated from an addition flow rate and a supplying flow rate to a coater, is allowed to be a predetermined time, a method of using a static mixer described, for example, in N. Harnby, M. F. Edwards & A. W. Nienow, (translated by Koji Takahashi), "Liquid Mixing Technology" Chap. 8, Nikkan Kogyo Shimbun (1989), or the like.

1-2. Organic Silver Salt

The organic silver salt recited in the invention is a fine particle dispersion prepared by a method comprising the steps of:

a. generating an organic silver salt by allowing an organic acid, or an alkali metal salt thereof and an aqueous silver salt to react with each other;

b. removing by-product salts by filtration;

c. drying; and d. dispersion (a dispersion comprising an organic silver salt, a protection colloid and water is dispersed up to a desired fine particle size).

The drying step c is not essential and the thus-generated organic silver salt can proceed to a next dispersing step d in a state of a wet cake comprising water to some extent.

Hereinafter, the organic silver salt will be described in detail.

1) Composition of Organic Silver Salt

The organic silver salt which can be used herein is relatively stable to light, but, when heated at 80° C. or more in the presence of an exposed photosensitive silver halide and a reducing agent, functions as a silver-ion supplier to form a silver image. Such non-photosensitive organic silver salts are described in, for example, paragraphs [0048] and [0049] of JP-A No. 10-62899, pp. 18 (line 24) to 19 (line 37) of EP-A No.0803764, EP-A No. 0962812, JP-A Nos. 11-349591, 2000-7683, and 2000-72711. Silver salts of organic acids, particularly, long chain aliphatic carboxylic acids (each having from 10 to 30 carbon atoms, preferably from 15 to 28 carbon atoms) are preferable. Preferable examples of silver salts of such aliphatic acids include silver lignocerate, silver behenate, silver arachidate, silver stearate, silver oleate, silver laurate, silver caproate, silver myristate, silver palmitate, silver erucate and mixtures thereof.

According to the invention, among these aliphatic acid silver salts, it is preferable to use aliphatic acid silver salts comprising 50 % by mol or more of silver behenate, preferably 90% by mol and more of silver behenate, further preferably 95% by mol or more of silver behenate. Silver behenate having the above-described range of high purity lowers the fogging, thereby being a preferable organic silver salt for attaining the object of the invention.

2) Grain Size and Shape

A shape of the organic silver salt that can be used for the invention is not particularly limited, and any form of acicular, rod-like, planar and scaly forms is permissible.

However, according to the invention, the organic silver salt in the scaly form is preferable. Further, a short acicular, rectangular, cubic or potato-like amorphous grain in which a ratio of length of a long axis to that of a short axis is 5 or less is also preferably used. These organic silver grains have characteristics that they exhibit lower fogging at the thermal development compared with a long acicular grain in which the ratio of the length of the long axis to that of the short axis is 5 or more. Particularly, the grain in which such ratio is 3 or less is preferable since mechanical stability of a coated film thereof can be enhanced.

Scaly organic silver salts as used herein are defined as described below. An organic silver salt is observed under an electronic microscope, and a shape of an organic silver salt grain is approximated to a rectangular parallelepiped. Three different edges of the rectangular parallelepiped are represented as a, b and c in which a is the shortest, c is the longest (c and b may be same with each other). From the shorter edges a and b, x is obtained according to the following equation:

$$x=b/a$$

Values of x are obtained for about 200 grains in a same manner as described above, and an average thereof x (average) is obtained. Samples that satisfy the relationship of x (average)≧1.5 are defined as being scaly. Scaly grains satisfying 30≧x (average)≧1.5, more preferably 20≧x (average)≧2.0 are preferable. And acicular grains satisfy 1≧x (average)≦1.5.

In scaly grains, it is understood that "a" corresponds to thickness of tabular grains wherein main planes are defined by the sides of b and c. An average of "a" is preferably from 0.01 μm to 0.23 μm, and more preferably from 0.1 μm to 0.23 μm. An average of c/b is preferably from 1 to 6, more preferably from 1 to 4, still more preferably from 1 to 3, and particularly preferably from 1 to 2.

A grain size distribution of the organic silver salts is preferably monodispersed. The term "monodispersed" as used herein means that the percentage of a value obtained by dividing the standard deviation of the length of the short axis by the length of the short axis and a value obtained by dividing the standard deviation of the length of the long axis by the length of the long axis, are preferably 100% or less, more preferably 80% or less, and still more preferably 50% or less. The shape of the organic silver salt can be determined from a transmission electron microscope image of an organic silver salt dispersion. Another method for determining the monodispesibility is a method involving obtaining the standard deviation of a volume-weighted average diameter of the organic silver salt. The percentage (coefficient of variation) of the value obtained by dividing the standard deviation by the volume-weighted average diameter is preferably 100% or less, more preferably 80% or less, and still more preferably 50% or less. A measurement method can be employing, for example, a commercially available laser light scattering-type particle size measuring apparatus.

3) Preparation Method of Organic Silver Salt

A preparation method of the organic acid silver according to the invention can adopt any one of known methods and the like. Methods described in, for example, JP-A No. 10-62899, EP-A Nos. 0803763, and 0962812, JP-A Nos. 11-349591, 2000-7683, 2000-72711, 2001-163889, 2001-163890, 2001-163827, 2001-033907, 2001-188313, 2001-083652, 2002-006442, 2002-031870, and Japanese Patent Application No. 2000-214155 can be referenced.

4) Dispersion Method

Next, a method for producing a solid dispersion of the organic silver salt will be described.

As for methods of media dispersion which have ordinarily been known so far, mentioned is a method in which powders of the organic silver salt or a wet cake of the organic silver salt prepared by adding water or an organic solvent thereto is converted to an aqueous slurry and, then, mechanically crushed in the presence of dispersion media by using a known crusher, thereby being dispersed. Examples of such crushers to be used in a media dispersion include a ball mill, a colloid mill, a vibration ball mill, a vertical-type sand mill, a roller mill, a pin mill, a cobowl mill, a caddy mill, a horizontal-type sand mill, and an attritor. Examples of such dispersion media include a steel ball, a ceramic ball, glass beads, alumina beads, zirconia silicate beads, zirconia beads and Ottawa sand. An average diameter of dispersion media (beads) is preferably in the range of from 0.3 mm to 5 mm, more preferably in the range of from 0.3 mm to 3 mm, still more preferably in the range of from 0.3 mm to 1 mm and most preferably 0.3 mm or 0.5 mm.

It is preferable to use a high-pressure homogenizer for preparing the dispersion of the silver salt of the organic acid. The high-pressure homogenizer is an apparatus in which high-pressure, high-speed dispersion is executed in a high-pressure crushing part provided in a midway of a dispersion flow path, or an apparatus in which dispersing, emulsifying, and crushing are executed by passing the dispersion at high-speed with high-pressure through the narrowed part of the flow path of the dispersion.

For example, Nanomizer LA (available from Nanomizer Co., Ltd.) in which dispersion liquids are collided with each other in the dispersion flow path, Microfluidizer (available from Microfluidex International Corp.) or Gaulin Homogenizer (available from APV Gaulin) in which a high-pressure crushing part is provided in the flow path of the dispersion liquid, and Genus PY (available from Genus Co., Ltd.) in which a narrow tubular flow path called as an orifice is provided in the flow path of the dispersion liquid can be used.

The high-pressure crushing part provided in the high-pressure homogenizer according to the invention denotes regions 11 and 12 shown in FIG. 1 in which a flow path of a raw material solution passing through the dispersion apparatus is bent at an approximately right angle to obtain an organic silver salt dispersion in which the organic silver salt is crushed and dispersed when a high speed flow of the raw material solution passes through the high-pressure crushing part.

The term "approximately right angle" as used herein means that, when the flow path of the raw material solution proceeds to another flow path in a different direction, an angle at a corner to be formed by respective flow paths is in the range of from 70 degrees to 110 degrees.

As for the narrow tubular flow path (orifice) to be provided in the high-pressure homogenizer according to the invention, in order to prevent a dispersed material from clogging inside of the dispersion flow path, a flow path diameter thereof is, at the time of preliminary dispersion, preferably 0.1 mm ψ or more and more preferably 0.2 mm ψ or more. Further, the pressure applied to the dispersion is, at the time of the preliminary dispersion, preferably 5 $kgf/cm^2$ or more and more preferably 10 $kgf/cm^2$ or more. Furthermore, at the time of the main dispersion, the flow path diameter is preferably 0.5 mm ψ or less and more preferably 0.2 mm ψ or less. Moreover, the pressure to be applied to the dispersions is preferably 100 $kgf/cm^2$ or more and more preferably 280 $kgf/cm^2$ or more.

According to the invention, the raw material solution comprising at least the organic silver salt, a solvent and a protective colloid is subjected, first, to a preliminary dispersion at least once and, next, to a main dispersion whereupon, the preliminary dispersion is performed by using a larger dispersion flow path diameter than that to be used at the time of the main dispersion so that at the time of the main dispersion, clogging inside of the dispersion flow path by the dispersed material can be prevented and the organic silver salt dispersion excellent in a dispersion state can also be obtained.

Figure 2:
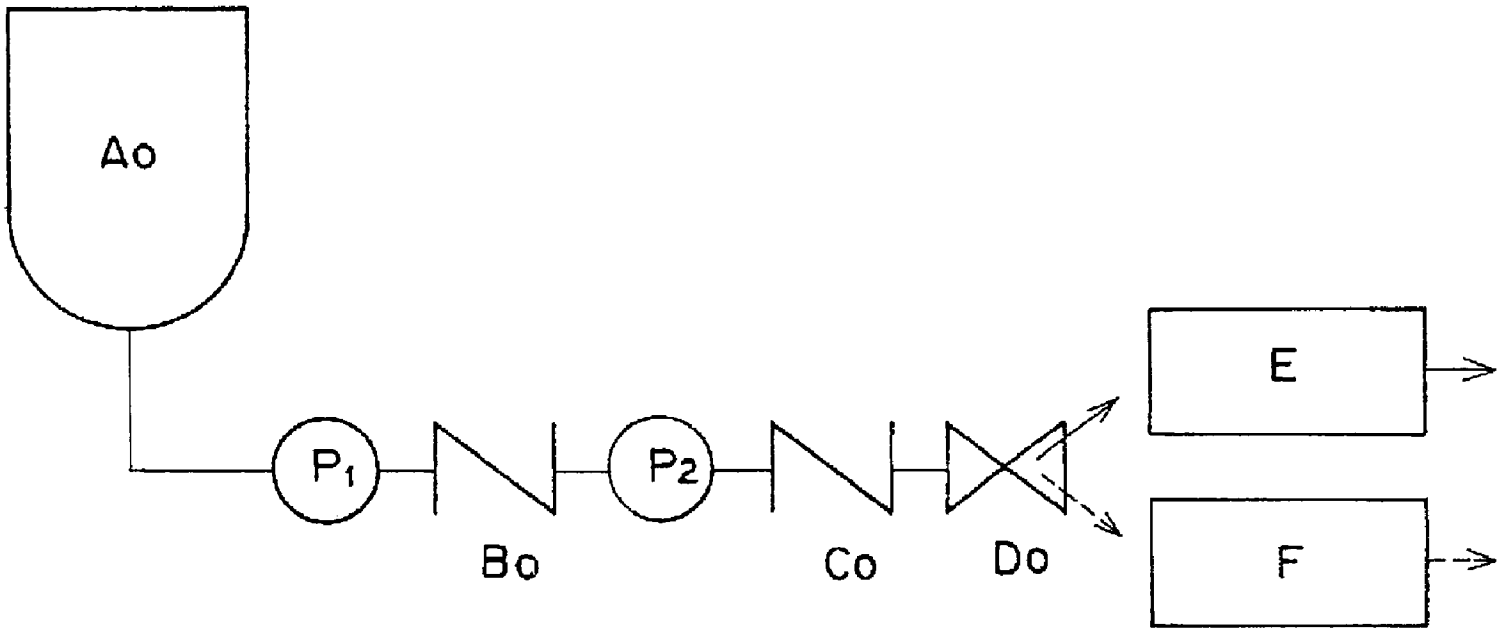
FIG. 2 is a diagram showing an example in which a preliminary dispersion and a main dispersion are executed by a single dispersion apparatus by operating a selector valve.
Figure 3:
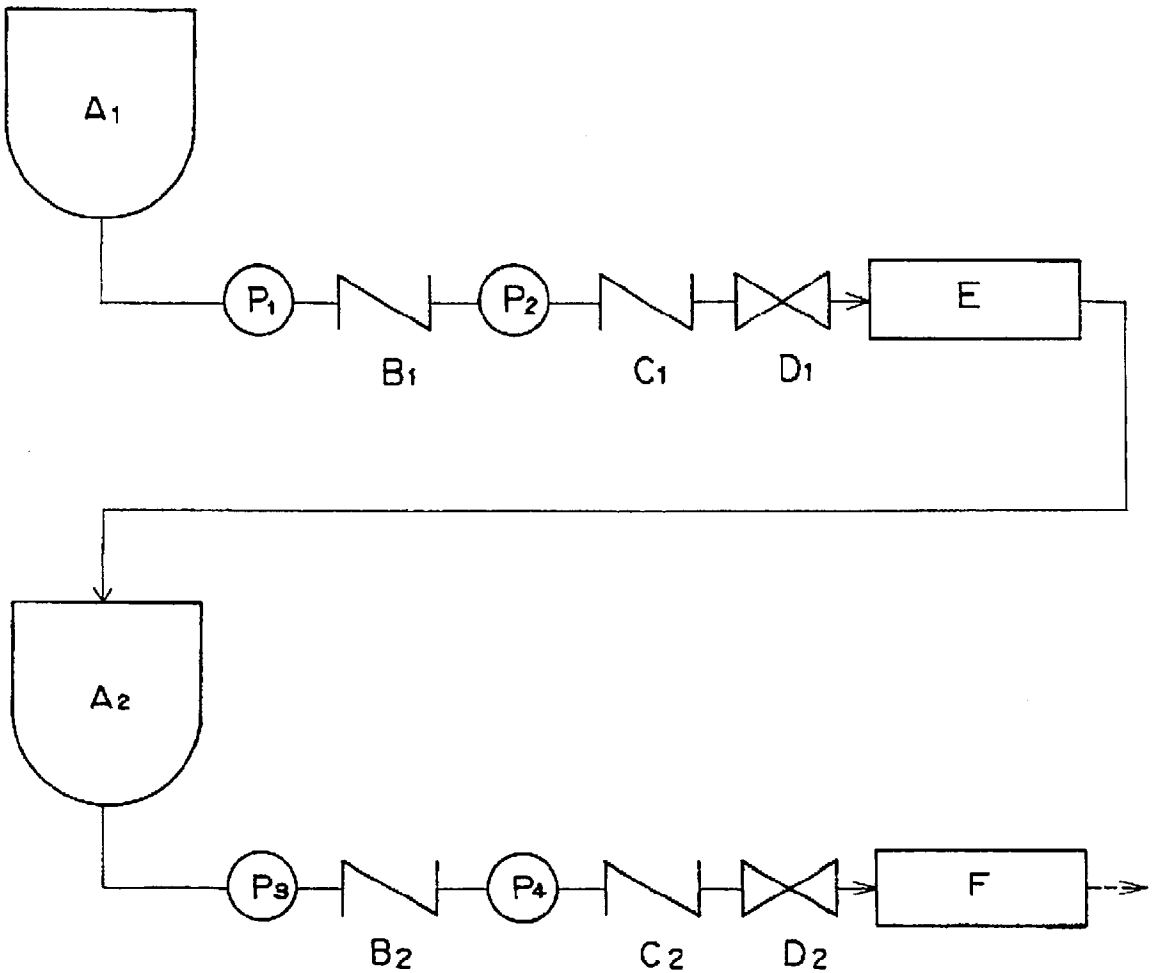
FIG. 3 is a diagram showing an example in which a preliminary dispersion and a main dispersion are each independently executed by separately arranged dispersion apparatuses.

The preliminary dispersion and the main dispersion to be performed in the production method according to the invention are specifically performed by using apparatuses as shown in FIGS. 2 and 3.

In the apparatus shown in FIG. 2, the raw material solution is supplied from a supply pot A0 to an auxiliary pump P1 and, then, through a check valve B0, a high-pressure pump P2 and a check valve C0, introduced into an orifice E for the preliminary dispersion by a selector valve D0, thereby performing the preliminary dispersion. After the preliminary dispersion, the thus-obtained preliminary dispersion is returned into the supply pot A0 and, then, after taking the same route, introduced into an orifice F for the main dispersion by a selector valve D0, thereby performing the main dispersion.

In the apparatus shown in FIG. 3, the raw material solution is introduced from a supply pot A1, through an auxiliary pump P1, a check valve B1, a high-pressure pump P2, a check valve C1, and a selector valve D1, to an orifice E for the preliminary dispersion, thereby performing the preliminary dispersion. The resultant preliminary dispersion is supplied to a separately arranged supply pot A2 and, then, through an auxiliary pump P3, a check valve B2, a high-pressure pump P4, a check valve C2 and a selector valve D2, introduced into an orifice F for the main dispersion, thereby performing the main dispersion.

In the production method according to the invention, the temperature of the dispersion liquid may optionally be controlled. An adjustment of a temperature of the raw material solution before dispersion may be performed either in a tank in which the raw material solution is contained or in the midway from the tank to a dispersion operation part of the high-pressure homogenizer. Particularly, when the dispersion liquid is cooled to a dew point or less, since there is a problem in cooling in the tank that there is a possibility of dew formation, such temperature adjustment is preferably performed in a hermetically arranged flow path from the tank to the dispersion operation part.

Further, as a method for increasing a pressure to be applied to the dispersion liquid in the high-pressure homogenizer according to the invention, a method of closing an outlet of a single flow path by a collision plate, a method of allowing a midway of the flow path to be a narrow tubular flow path (orifice) or the like may be used.

Further, when the photosensitive silver salt is allowed to be concurrently present at the time the organic silver salt is dispersed, the fogging is increased to tremendously reduce sensitivity; therefore, it is preferable that the photosensitive silver salt is not virtually contained at the time of such dispersion. According to the invention, the amount of the photosensitive silver salt in an aqueous dispersion to be dispersed is, based on 1 mol of the organic acid silver salt in the aqueous dispersion, 1% by mol or less, more preferably 0.1% by mol or less and still more preferably no active addition of the photosensitive silver salt is executed.

5) Annealing Treatment

The organic silver salt according to the invention is characterized in that the organic silver salt is subjected to an annealing treatment after being dispersed. When the organic silver salt dispersion according to the invention is used after being subjected to the annealing treatment, it is found that the photothermographic material to be obtained is low in fogging and shelf-stability thereof is enhanced. As is shown in the examples, there is no difference of a particle size distribution before and after the annealing treatment and there is no phenomenon such as dissolution of the fine particle. Therefore, such effect is different from the phenomenon, that micro particle components generated at the media-dispersion are dissolved to make even the sizes of the fine particles around the average size, described in JP-A No. 2002-55405. In a case described in JP-A No. 2002-55405, such decrease of micro particle components contributes to precipitation stability of the dispersion during storage. Although mechanism of the effect of the annealing treatment of the organic silver salt according to the invention is not clear, since there is no variation in a particle size distribution, and, also, an effect to be obtained is not the precipitation stability of the dispersion but is an improvement of fogging property of a coated material to be obtained or an improvement of variation of photographic properties of the coated material during storage, the effect of the annealing treatment recited in the invention is completely different from that of the conventional annealing treatment in terms of a physical change to be imparted or a photographical effect obtained.

The term "annealing treatment" as used herein is intended to mean that the organic silver salt dispersion which has completed a dispersion process is stored at a temperature of 30° C. or more. As the temperature becomes higher in the range above 30° C., the annealing treatment is performed in a shorter period of time. However, when the temperature becomes as high as 90° C. or more, the fogging is increased again; therefore, there is an optimum temperature range. As for the time period, when the time period is unduly short, the effect becomes insufficient, while, when the time period is unduly long, the fogging is increased again, which is an unfavorable phenomenon; therefore, there is an optimum range of time period.

The temperature of the annealing treatment is preferably in the range of from 30° C. to 90° C., more preferably in the range of from 30° C. to 60° C., while the time period thereof is preferably in the range of from 0.1 hour to 30 days and more preferably in the range of from 1 hour to 15 days.

The annealing treatment may be performed with or without stirring of the dispersion. Further, the annealing treatment may be performed while the dispersion is hermetically contained in a container or in an open system. The annealing treatment may be performed either while the dispersion contacts the atmospheric air or while the dispersion is hermetically contained in a container which is intentionally filled with an inert gas such as a nitrogen gas, a helium gas or an argon gas. A practically preferable method is a method of storing a container, in which the dispersion is hermetically contained while keeping the amount of the air and the area of a vapor-liquid interface therein to be minimum, in a storage vault at a temperature of 30° C. or more. When the annealing treatment is performed succeeding to the dispersion step, it is preferable to keep the dispersion at a temperature of 30° C. or more and, also, higher than the temperature at dispersion, while being stirred.

After the annealing treatment is completed, it is preferable to keep the organic silver salt in a refrigerator.

6) Coating Amount of Organic Silver Salt

The organic silver salt according to the invention can be used in a desired amount. The entire quantity of silver to be coated inclusive of the amount of a silver halide is preferably in the range of from 0.1 g/m$^2$ to 5.0 g/m$^2$, more preferably in the range of from 0.3 g/m$^2$ to 3.0 g/m$^2$ and still more preferably in the range of from 0.5 g/m$^2$ to 2.0 g/m$^2$. Particularly, in order to enhance the shelf-stability of the image, the entire quantity of silver to be coated is preferably 1.8 g/m$^2$ or less and more preferably 1.6 g/m$^2$ or less. When a preferable reducing agent ricited in the invention is used, it is possible to obtain a sufficient image density even with such a low amount of silver as described above.

1-3. Reducing Agent

It is preferable that the photothermographic material according to the invention comprises a thermal developing agent which is a reducing agent for the organic silver salt. The reducing agent for the organic silver salt may be any substance (preferably organic substance), so long as it can reduce a silver ion to metallic silver. Examples of such reducing agents include those described in paragraphs [0043] to [0045] of JP-A No. 11-65021, and in pp. 7 (line 34) to 18 (line 12) of EP-A No. 0803764.

Preferable reducing agents according to the invention are compounds represented by the general formula (R) as described below. These compounds will be described in detail.

General Formula (R)

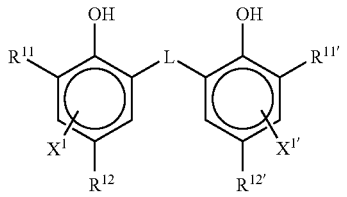

wherein $R^{11}$ and $R^{11'}$ each independently represent an alkyl group having 1 to 20 carbon atoms;

$R^{12}$ and $R^{12'}$ each independently represent a hydrogen atom or a substituent with which a benzene ring can be substituted;

L represents a group of —S— or —CHR$^{13}$, wherein $R^{13}$ represents a hydrogen atom or an alkyl group having from 1 to 20 carbon atoms; and $X^1$ and $X^{1'}$ each independently represent a hydrogen atom or a group with which a benzene ring can be substituted.

Now, each substituent will be described in detail.

1) $R^{11}$ and $R^{11'}$ $R^{11}$ and $R^{11'}$ each independently represent an alkyl group having 1 to 20 carbon atoms which may have a substituent, whereupon a substituent of the alkyl group is not particularly limited and preferable examples of such substituents include an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom.

2) $R^{12}$ and $R^{12'}$, and $X^1$ and $X^{1'}$ $R^{12}$ and $R^{12'}$ each independently represent a hydrogen atom or a group with which a benzene ring can be substituted.

$X^1$ and $X^{1'}$ each independently represent a hydrogen atom or a group with which a benzene ring can be substituted.

Preferable examples of such groups which can be substituted by a benzene ring include an alkyl group, an aryl group, a halogen atom, an alkoxy group and an acylamino group.

3) L

L represents a group of —S— or —$CHR^{13}$—. $R^{13}$ represents a hydrogen atom or an alkyl group having 1 to 20 carbon atoms which may have a substituent.

Specific examples of such alkyl groups represented by $R^{13}$ which does not have a substitutent include a methyl group, an ethyl group, a propyl group, a butyl group, a heptyl group, an undecyl group, an isopropyl group, a 1-ethylpentyl group, and a 2,4,4-trimethylpentyl group.

Examples of substituents of the alkyl groups, being the same as those of $R^{11}$, include a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, and a sulfamoyl group.

4) Preferable Substituents $R^{11}$ and $R^{11'}$ are preferably a secondary or tertiary alkyl group having 3 to 15 carbon atoms whereupon examples of such alkyl groups include an isopropyl group, an isobutyl group, a t-butyl group, a t-amyl group, a t-octyl group, a cyclohexyl group, a cyclopentyl group, a 1-methylcyclohexyl group, and a 1-methylcyclopropyl group. $R^{11}$ and $R^{11'}$ are more preferably a tertiary alkyl group having 4 to 12 carbon atoms, still more preferably a t-butyl group, a t-amyl group, and a 1-methylcyclohexyl group, and most preferably a t-butyl group.

$R^{12}$ and $R^{12'}$ are preferably an alkyl group having from 1 to 20 carbon atoms whereupon specific examples of such alkyl groups include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, and a methoxyethyl group, and more preferably a methyl group, an ethyl group, a propyl group, an isopropyl group and a t-butyl group.

$X^1$ and $X^{1'}$ are preferably a hydrogen atom, a halogen atom, and an alkyl group, and more preferably a hydrogen atom.

L is preferably a group of —$CHR^{13}$—.

$R^{13}$ is preferably a hydrogen atom or an alkyl group having 1 to 15 carbon atoms whereupon preferable examples of such alkyl groups include a methyl group, an ethyl group, a propyl group, an isopropyl group, and 2,4,4-trimethylpentyl group. $R^{13}$ is more preferably a hydrogen atom, a methyl group, a propyl group and an isopropyl group.

When $R^{13}$ is a hydrogen atom, $R^{12}$ and $R^{12'}$ are preferably an alkyl group having 2 to 5 carbon atoms whereupon an ethyl group and a propyl group are more preferable and an ethyl group is most preferable.

When $R^{13}$ is a primary or secondary alkyl group having 1 to 8 carbon atoms, $R^{12}$ and $R^{12'}$ are preferably a methyl group. As for the primary or secondary alkyl group of $R^{13}$ having 1 to 8 carbon atoms, a methyl group, an ethyl group, a propyl group, an isopropyl group are more preferable, and a methyl group, an ethyl group and a propyl group are still more preferable.

When each of $R^{11}$, $R^{11'}$, $R^{12}$, and $R^{12'}$ is a methyl group, $R^{13}$ is preferably a secondary alkyl group. On this occasion, as for such secondary alkyl groups, an isopropyl group, an isobutyl group, and a 1-ethylpentyl group are preferable, and an isopropyl group is more preferable.

Various types of thermal developing properties of these reducing agents can be changed by the combination of $R^{11}$, $R^{11'}$, $R^{12}$, $R^{12'}$, and $R^{13}$. Since the thermal developing properties of reducing agents can be adjusted by using at least two types of reducing agents in combination at various types of combination ratios. Thus, it is preferable, depending on applications, to use at least two types of reducing agents in combination.

Specific examples of compounds represented by the general formula (R) recited in the invention are described below; however, the invention is by no means limited by the examples.

(R-1)

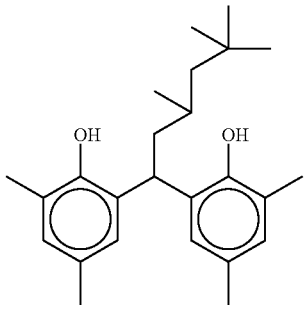

(R-2)

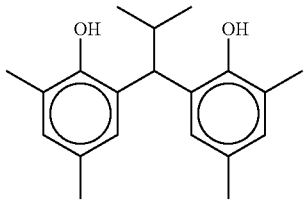

(R-3)

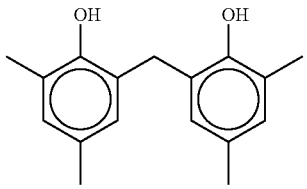

(R-4)

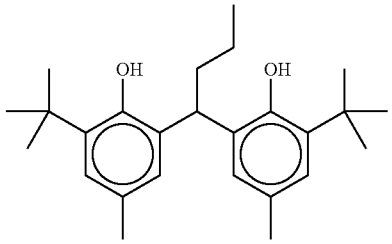

(R-5)

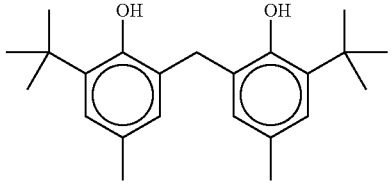

(R-6)

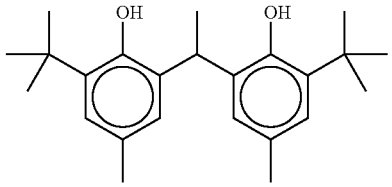

-continued
(R-7)
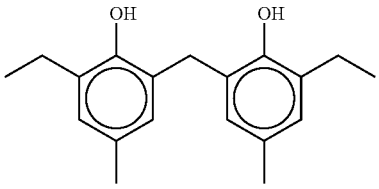
(R-8)
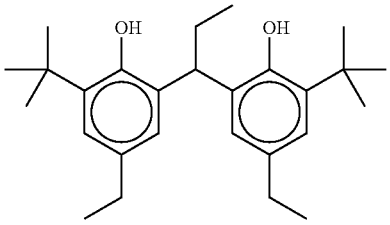
(R-9)
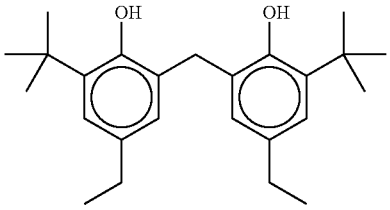
(R-10)
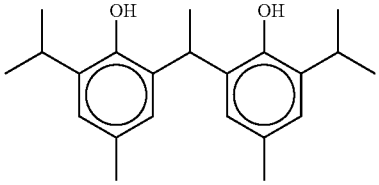
(R-11)
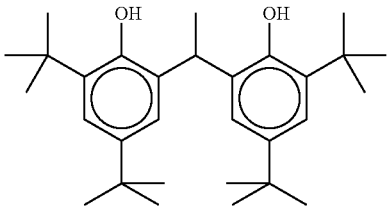
(R-12)
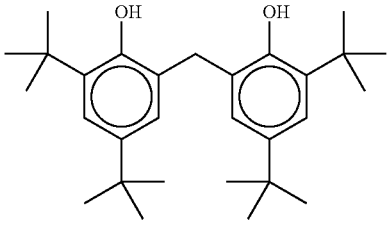
(R-13)
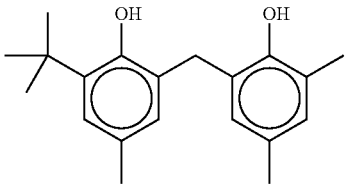
-continued
(R-14)
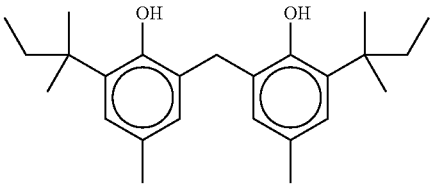
(R-15)
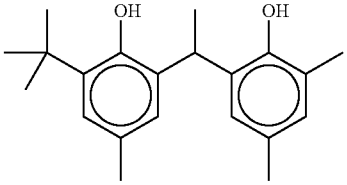
(R-16)
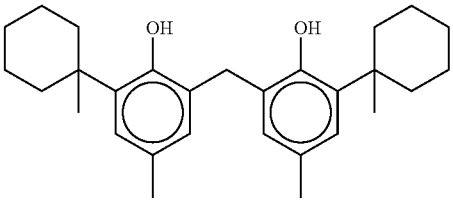
(R-17)
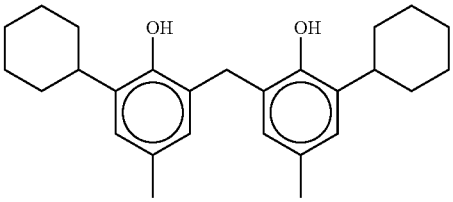
(R-18)
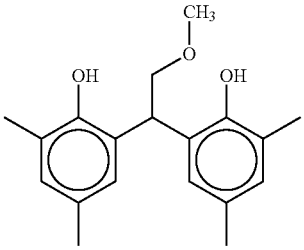
(R-19)
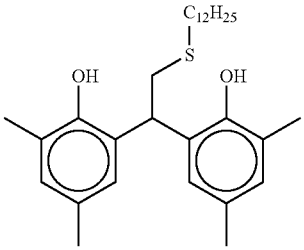
(R-20)
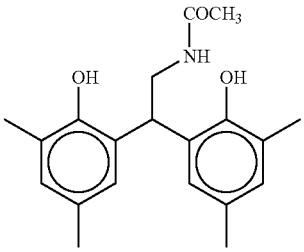

-continued
(R-21)
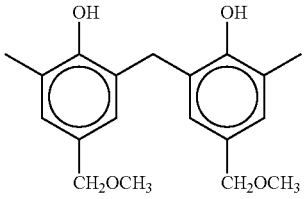
(R-22)
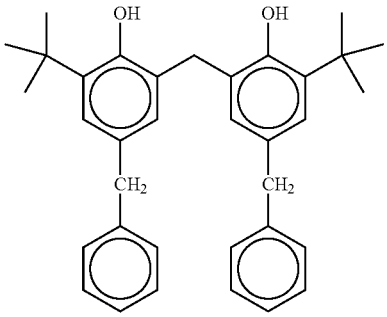
(R-23)
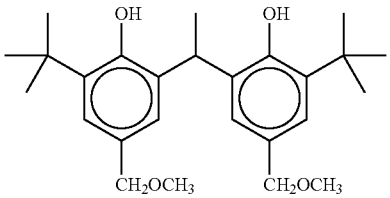
(R-24)
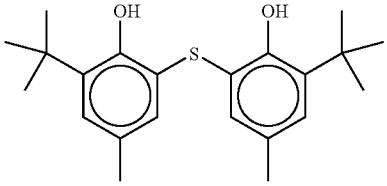
(R-25)
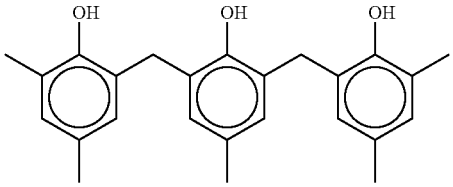
(R-26)
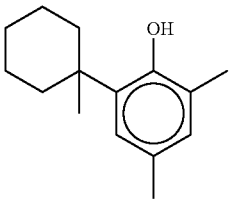
(R-27)
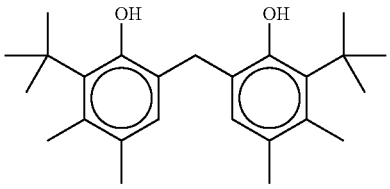
-continued
(R-28)
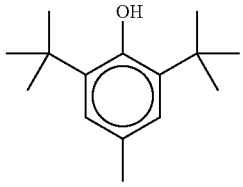
(R-29)
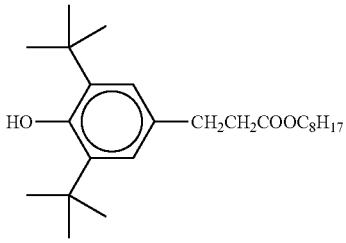
(R-30)
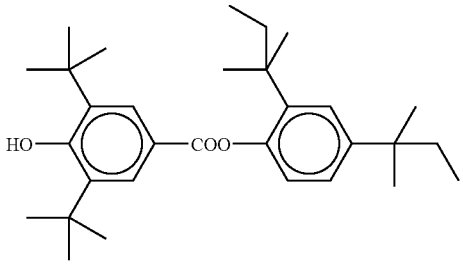
(R-31)
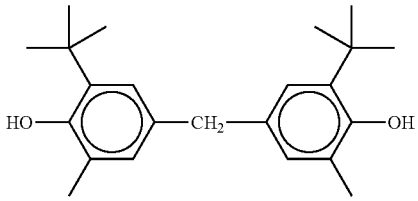
(R-32)
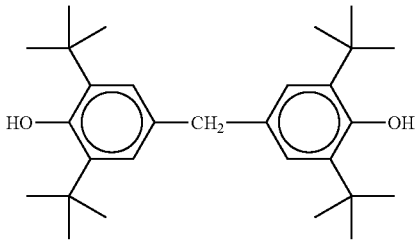
(R-33)
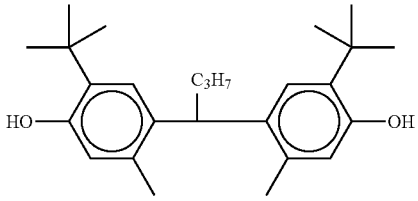

-continued (R-34)

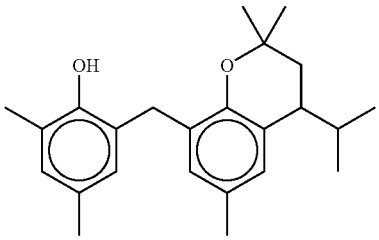

The addition amount of the reducing agent according to the invention is preferably from 0.01 g/m$^2$ to 5.0 g/m$^2$, more preferably from 0.1 g/m$^2$ to 3.0 g/m$^2$. The addition amount of the reducing agent is, based on 1 mol of silver in layers on the side of the support having an image forming layer, preferably from 5% by mol to 50% by mol and more preferably from 10% by mol to 40% by mol.

The reducing agent recited in the invention can be added in the image forming layer containing the organic silver salt and the photosensitive silver halide, and a layer adjacent thereto. It is more preferable to allow the reducing agent to be contained in the image forming layer.

The reducing agent recited in the invention may be contained in the coating solution in any form of solution form, emulsion-dispersion form, solid fine particle dispersion form and the like to be contained in the photosensitive material.

Particularly favorable addition method is the foregoing solid fine particle dispersion method. The reducing agent is added in a form of fine particles having the average particle size of preferably from 0.01 μm to 10 μm, more preferably from 0.05 μm to 5 μm, and further more preferably from 0.1 μm to 1 μm.

1-4. Developing Accelerator

In the photothermographic material recited in the invention, sulfonamide phenolic compounds represented by the general formula (A) as described in JP-A Nos. 2000-267222 and 2000-330234, hindered phenolic compounds represented by the general formula (II) as described in JP-A No. 2001-92075, hydrazine-type compounds represented by the general formula (I) as described in JP-A Nos. 10-62895 and 11-15116 and also the general formula (1) as described in JP-A No. 2002-278017, and phenolic or naphthol-type compounds represented by the general formula (2) as described in JP-A No. 2001-264929 are favorably used. These developing accelerators are used, with respect to the reducing agent, in the range of from 0.1% by mol to 20% by mol, preferably in the range of from 0.5% by mol to 10% by mol, and more preferably in the range of from 1% by mol to 5% by mol. The developing accelerator is introduced to the photosensitive material by added to the coating solution in a form of a solid fine particle dispersion, as in the case of the reducing agent.

Among the above-described developing accelerators according to the invention, hydrazine-type compounds represented by the general formula (1) as described in JP-A No. 2002-278017 and phenolic or naphthol-type compounds represented by the general formula (2) as described in JP-A No. 2001-264979 are particularly favorable.

Specific examples of developing accelerators according to the invention are described below; however, the invention is by no means limited by the examples.

(A-1)

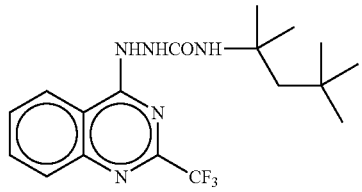

(A-2)

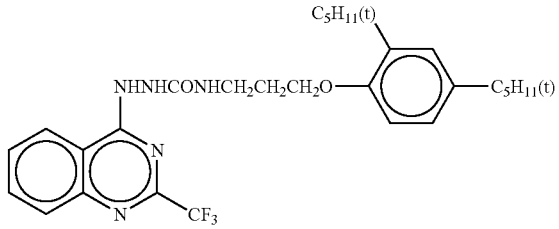

(A-3)

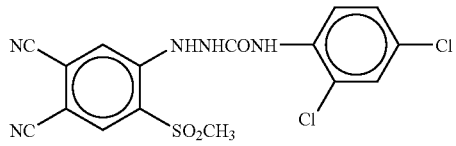

(A-4)

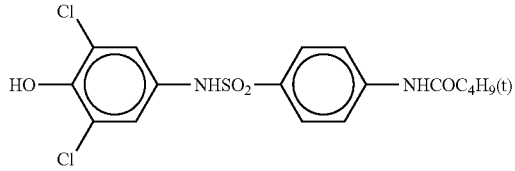

(A-5)

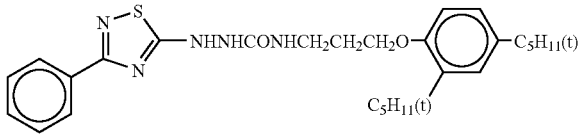

(A-6)

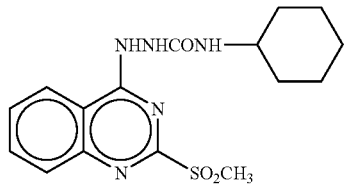

(A-7)

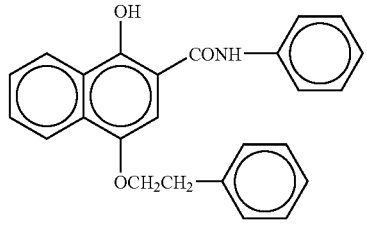

(A-8)

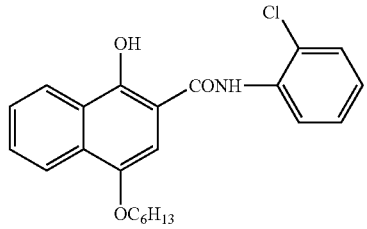

-continued (A-9)

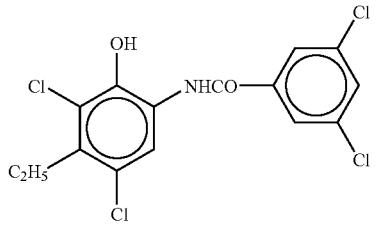

(A-10)

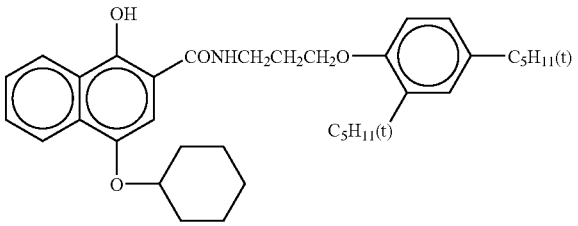

1-5. Hydrogen Bonding Compound

According to the invention, it is preferable that a non-reductive compound having a group capable of forming a hydrogen bond with an aliphatic hydroxyl group (—OH) of a reducing agent is used in combination with the reducing agent.

Examples of such groups each capable of forming a hydrogen bond include a phosphoryl group, a sulfoxide group, a sulfonyl group, a carbonyl group, an amide group, an ester group, an urethane group, an ureido group, a t-amino group, and a nitrogen-containing aryl group. Among these groups, a compound having a phosphoryl group, a sulfoxide group, an amide group (however, having no group of >N—H; being blocked in a form of >N-Ra wherein Ra represents a substituent exclusive of H), a urethane group (provided the urethane group does not have a group of >N—H and is blocked in a form of >N-Ra wherein Ra represents a substituent other than H), or a ureido group (provided the ureido group does not have a group of >N—H and is blocked in a form of >N-Ra wherein Ra represents a substituent other than H) is preferable.

Particularly favorable hydrogen bonding compounds according to the invention are compounds represented by the following general formula (D):

General formula (D)

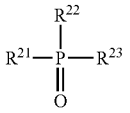

wherein $R^{21}$, $R^{22}$, and $R^{23}$ each independently represent an alkyl group, an aryl group, an alkoxy group, an aryloxy group, an amino group, or a heterocyclic group, which may be substituted.

When any one of $R^{21}$, $R^{22}$, and $R^{23}$ has a substituent, examples of such substituents include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group and a phosphoryl group. The substituent is preferably an alkyl group or an aryl group such as a methyl group, an ethyl group, an isopropyl group, a t-butyl group, a t-octyl group, a phenyl group, a 4-alkoxyphenyl group, and a 4-acyloxyphenyl group.

Specific examples of such alkyl groups of $R^{21}$, $R^{22}$, and $R^{23}$ include a methyl group, an ethyl group, a butyl group, an octyl group, a dodecyl group, an isopropyl group, a t-butyl group, a t-amyl group, a t-octyl group, a cyclohexyl group, 1-methylcyclohexyl group, a benzyl group, a phenethyl group, and a 2-phenoxypropyl group.

Specific examples of such aryl groups include a phenyl group, a cresyl group, a xylyl group, a naphthyl group, a 4-t-butylphenyl group, a 4-t-octylphenyl group, a 4-anisidyl group, and a 3,5-dichlorophenyl group.

Specific examples of such alkoxy groups include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, and a benzyloxy group.

Specific examples of such aryloxy groups include a phenoxy group, a cresyloxy group, an isopropylphenoxy group, a 4-t-butylphenoxy group, a naphthoxy group, and a biphenyloxy group.

Specific examples of such amino groups include a dimethylamino group, a diethylamino group, a dibutylamino group, a dioctylamino group, an N-methyl-N-hexylamino group, a dicyclohexylamino group, a diphenylamino group, and an N-methyl-N-phenylamino group.

As for $R^{21}$, $R^{22}$, and $R^{23}$, an alkyl group, an aryl group, an alkoxy group, and an aryloxy group is preferable. From the standpoint of an effect recited in the invention, it is preferable that at least one of $R^{21}$, $R^{22}$ and $R^{23}$ is an alkyl group or an aryl group, and it is more preferable that at least two of $R^{21}$, $R^{22}$ and $R^{23}$ are an alkyl group or an aryl group. Further, taking availability at a low price into consideration, it is preferable that $R^{21}$, $R^{22}$, and $R^{23}$ are a same group with one another.

Specific examples of hydrogen bonding compounds inclusive of compounds represented by the general formula (D) according to the invention are described below; however, the invention is by no means limited by the examples.

(D-1)

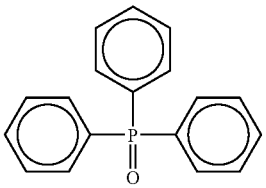

(D-2)

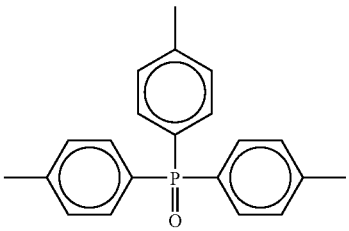

-continued
(D-3)
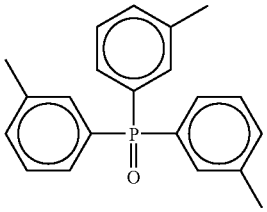
(D-4)
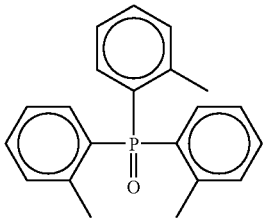
(D-5)
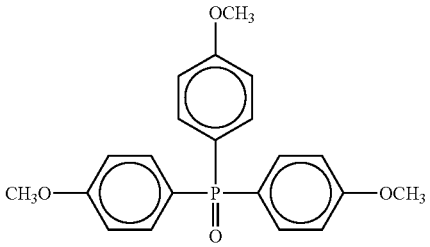
(D-6)
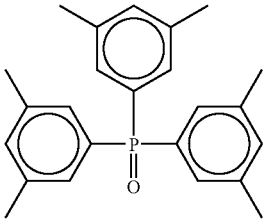
(D-7)
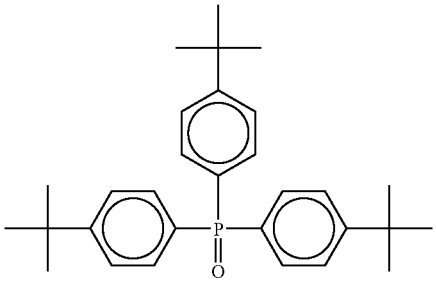
(D-8)
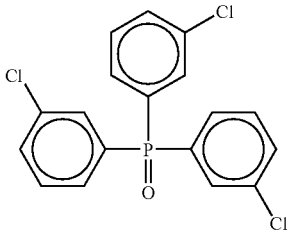
(D-9)
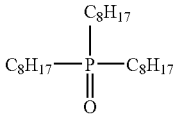
-continued
(D-10)
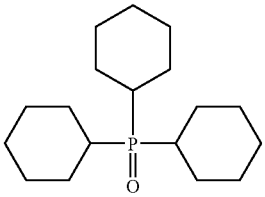
(D-11)
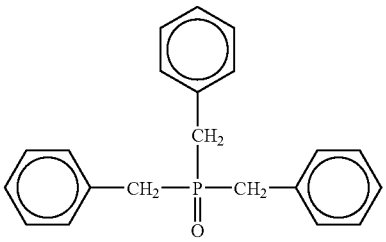
(D-12)
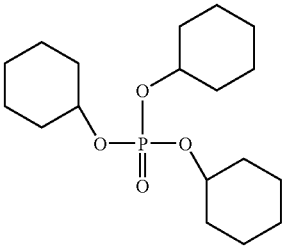
(D-13)
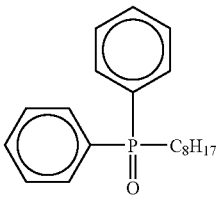
(D-14)
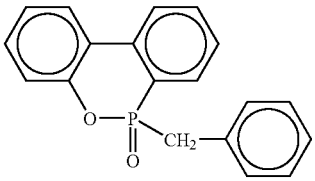
(D-15)
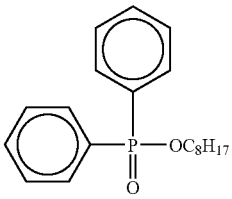
(D-16)
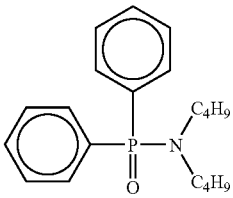

-continued (D-17)

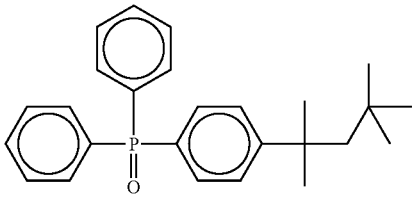

(D-18)

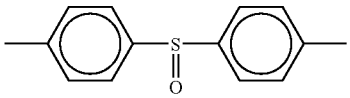

(D-19)

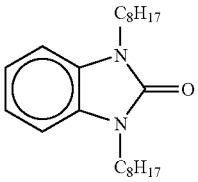

(D-20)

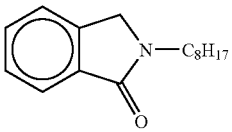

(D-21)

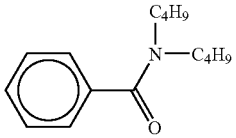

Specific examples of hydrogen bonding compounds further include those as described in JP-A Nos. 2001-281793 and 2002-14438.

The hydrogen bonding compound recited in the invention may be added in the coating solution, in a form of solution form, emulsion-dispersion form, and solid fine particle dispersion form to be contained in the photosensitive material, as in the case of the reducing agent. The hydrogen bonding compound recited in the invention forms a hydrogen bonding complex with the compound having a phenolic hydroxyl group in a solution state. The complex can be isolated in a crystal state, depending on the combination of the reducing agent and the compound represented by the general formula (D) recited in the invention,.

It is particularly favorable from the standpoint of obtaining a stable performance that the thus-isolated crystal powders are used as the solid fine particle dispersion. Further, favorably used is a method in which the reducing agent and the hydrogen bonding compound are mixed in powder states with each other and, then, dispersed by using an appropriate dispersing agent by utilizing a sand grinder mill or the like to form a complex at the time of such dispersion.

The hydrogen bonding compound recited in the invention is used, with respect to the reducing agent, preferably in the range of 1% by mol to 200% by mol, more preferably in the range of 10% by mol to 150% by mol and still more preferably from 30% by mol to 100% by mol.

1-6. Binder

The binder in an layer containing the organic silver salt recited in the invention may be any polymer. Such binders are preferably transparent or semi-transparent and ordinarily colorless whereupon examples of the binders include natural resins, natural polymers, natural copolymers, synthetic resins, synthetic polymers, synthetic copolymers, and other media which form a film and specific examples thereof include gelatins, rubbers, poly(vinylalcohol)s, hydoxyethylcelluloses, cellulose acetates, cellulose acetate butyrates, poly(vinylpyrrolidone)s, casein, starch, poly(acrylic acid)s, poly(methylmethacrylic acid)s, poly(vinyl chloride)s, poly (methacrylic acid)s, styrene/maleic acid anhydride copolymers, styrene/ acrylonitrile copolymers, styrene/butadiene copolymers, poly(vinyl acetal)s (for example, poly(vinyl formal) and poly(vinyl butylal)), poly(ester)s, poly(urethane)s, phenoxy resins, poly(vinylidene chloride)s, poly (epoxide)s, poly(carbonate)s, poly(vinyl acetate)s, poly(olefin)s, cellulose esters and poly(amide)s. The binder in water, an organic solvent or an emulsion may form a film.

According to the invention, a glass transition temperature (hereinafter also referred to as "Tg") of the binder in the layer comprising the organic silver salt is preferably from −20° C. to 80° C., more preferably from 0° C. to 70° C., and still more preferably from 10° C. to 60° C.

Here, the Tg was calculated with the following equation:

$$1/Tg=\Sigma(Xi/Tgi)$$

Assuming the polymer is formed by copolymerization of n monomer components from i=1 to i=n, Xi is a weight ratio (ΣXi=1) of the i-th monomer and Tgi is a glass transition temperature (in absolute temperature) of a homopolymer of the i-th monomer, provided that Σ is a sum of the values for i=1 to i=n.

Further, for the value (Tgi) of glass transition temperature of the homopolymer made from each monomer, values described in J. Brandrup and E. H. Immergut, Polymer Handbook, 3rd Edition, Willey-interscience (1989) have been adopted.

The binder polymer may be used alone or in combination of two or more types of them according to necessity. A combination of a polymer having Tg of 20° C. or more and a polymer having Tg of less than 20° C. may also be used. When two or more types of polymers having different Tg values are blended, it is preferable that a weight average Tg is within the range described above.

According to the invention, properties of the photothermographic material are improved when the layer containing the organic silver salt has been formed by coating a coating solution comprising 30% by mass or more of water on the basis of the mass of the total solvent and, then, drying the layer and, further, when the binder in the layer comprising the organic solver salt is soluble or dispersible in an aqueous solvent (a water-base solvent), and, in particular, when the binder comprises a latex of polymer in which an equilibrium moisture content at 25° C. 60% RH is 2% by mass or less.

The most preferable embodiment is such a form as is prepared such that an ionic conductivity of a binder solution becomes 2.5 mS/cm or less. As for such preparation method, mentioned is a purification method using a separation membrane after the synthesis of the polymer.

Here, the aqueous solvent in which the polymer is soluble or dispersible means water or a mixture of water and 70% by mass or less of a water-mixable organic solvent.

Examples of such water-mixable organic solvents include alcohol solvents such as methyl alcohol, ethyl alcohol and propyl alcohol, cellosolve solvents such as methyl cellosolve, ethyl cellosolve and butyl cellosolve, ethyl acetate, and dimethyl formamide.

Further, the term "equilibrium moisture content at 25° C. 60% RH" can be expressed by using a weight W1 of a polymer in a moisture equilibrium with the atmosphere at 25° C. 60% RH and a weight W0 of the polymer in the absolutely dry state, as shown in the following equation:

The equilibrium moisture content at 25° C. 60%
$RH=\{(W1-W0)/W0\}\times 100$ (% by mass)

Regarding the definition and a measurement method of the moisture content, for example, "Koubunshikougakukouza14, Koubunshizairyoushikennhou", compiled by the Society of Polymer Science of Japan, Chijin Shokan (Publishing) can be referred.

The equilibrium moisture content of the binder polymer according to the invention at 25° C. 60% RH is preferably 2% by mass or less, more preferably from 0.01% by mass to 1.5% by mass, and further preferably from 0.02% by mass to 1% by mass.

As for the binders recited in the invention, a polymer dispersible in an aqueous solvent is particularly preferred. Examples of dispersed states include a latex in which fine particles of a water-insoluble, hydrophobic polymer are dispersed and a dispersion in which polymer molecules are dispersed in a molecular state or in a micelle state. Both of them are favorable. The average particle diameter of dispersed particles is preferably from 1 nm to 50,000 nm, and more preferably, approximately, from 5 nm to 1,000 nm. The particle diameter distribution of the dispersed particles is not particularly limited whereupon either of dispersed particles having a broad particle diameter distribution or having a monodispersed particle diameter distribution may be used.

According to the invention, examples of preferably usable embodiments of polymers dispersible in aqueous solvents include hydrophobic polymers such as acrylic polymers, poly(ester)s, rubbers (for example, SBR resins), poly(urethane)s, poly(vinyl chloride)s, poly(vinyl acetate)s, poly (vinylidene chloride)s and poly(olefin)s. These polymers may be a linear polymer, a branched-chain polymer, a cross-linked polymer, a so-called homopolymer in which monomers of a single type have been polymerized, or a copolymer in which monomers of two or more types have been polymerized. In case of the copolymer, it may be either of a random copolymer or a block copolymer.

The molecular weight of each of these polymers is, in terms of the number average molecular weight, from 5,000 to 1,000,000 and preferably from 10,000 to 200,000. When a polymer having an unduly small molecular weight is used, dynamic strength of the emulsion layer becomes insufficient. When a polymer having an unduly large molecular weight is used, film-forming properties are deteriorated. Both of these cases are not preferable.

Specific examples of the preferable polymer latex include the following materials. In the following, a material is expressed by using a starting monomer; a value in a parenthesis is indicated in terms of "% by mass"; and a molecular weight means a number average molecular weight. In case that multi-functional monomers have been used, the concept of molecular weight can not be applied, since cross-linked structures are formed. Accordingly, such a case is marked as "cross-linking" to omit description of molecular weight. Tg means a glass transition temperature.

P-1; a latex (MW: 37,000; Tg: 61° C.) of MMA(70)/EA (27)/MAA(3)

P-2; a latex (MW: 40,000; Tg: 59° C.) of MMA(70)/2EHA (20)/St(5)/AA(5)

P-3; a latex (cross-linking; Tg: −17° C.) of St(50)/Bu(47)/MAA(3)

P-4; a latex (cross-linking; Tg: 17° C.) of St(68)/Bu(29)/AA(3)

P-5; a latex (cross-linking; Tg: 24° C.) of St(71)/Bu(26)/AA(3)

P-6; a latex (cross-linking) of St(70)/Bu(27)/IA(3)

P-7; a latex (cross-linking; Tg: 29° C.) of St(75)/Bu(24)/AA(1)

P-8; a latex (cross-linking) of St(60)/Bu(35)/DVB(3)/MAA (2)

P-9; a latex (cross-linking) of St(70)/Bu(25)/DVB(2)/AA(3)

P-10; a latex (MW: 80,000) of VC(50)/MMA(20)/EA(20)/AN(5)/AA(5)

P-11; a latex (MW: 67,000) of VDC(85)/MMA(5)/EA(5)/MAA(5)

P-12; a latex (MW: 12,000) of Et(90)/MAA(10)

P-13; a latex (MW: 130,000; Tg: 43° C.) of St(70)/2EHA (27)/AA(3)

P-14; a latex (MW 33,000; Tg: 47° C.) of MMA(63)/EA (35)/AA(2)

P-15; a latex (cross-linking; Tg: 23° C.) of St(70.5)/Bu (26.5)/AA(3)

P-16; a latex (cross-linking; Tg: 20.5° C.) of St(69.5)/Bu (27.5)/AA(3)

Abbreviations in the above structures show the following monomers. MMA; methyl metacrylate, EA; ethy acrylate, MAA methacylic acid, 2EHA; 2-ethylhexyl acrylate, St; Styrene, Bu; Butadiene, AA; acrylic acid, DVB; divinyl benzene, VC; vinyl chloride, AN; acrylonitrile, VDC; vinylidene chloride, Et; ethylene, and IA; itaconic acid.

Polymer latices described above are commercially available and such products as described below can be ulilized. Examples of acrylic polymers include Cevian A-4635, 4718 and 4601 (these are manufactured by Daicel Chemical Industries, Ltd.) and Nipol Lx811, 814, 821, 820 and 857 (these are manufactured by Zeon Corp.). Examples of poly (ester)s include FINETEX ES650, 611, 675 and 850 (these are manufactured by Dainippon Ink & Chemicals Inc.) and WD-size and WMS (these are manufactured by Eastman Chemical Company). Examples of poly (urethane)s include HYDRAN AP10, 20, 30 and 40 (these are manufactured by Dainippon Ink & Chemicals Inc.). Examples of rubbers include LACSTAR 7310K, 3307B, 4700H and 7132C (these are manufactured by Dainippon Ink & Chemicals Inc.) and Nipol Lx416, 410, 438C and 2507 (these are manufactured by Zeon Corp.). Examples of poly(vinyl chloride)s include G351 and G576 (these are manufactured by Zeon Corp.). Examples of poly(vinylidene chloride)s include L502 and L513 (these are manufactured by Asahi Chemical Industry Co., Ltd.). Examples of poly (olefin)s include Chemipearl S120 and SA100 (these are manufactured by Mitsui Petrochemical Industries, Ltd.).

These polymer latices may be used alone or two or more types of latices may be blended depending on the necessity.

As for the polymer latices recited in the invention, in particular, a latex of a styrene/butadiene copolymer is preferred. It is preferable that a weight ratio of styrene monomer units to butadiene monomer units is in the range of from 40:60 to 95:5. Further, it is preferable that a ratio of styrene monomer units together with butadiene monomer units in the copolymer is in the range of from 60% by mass to 99% by mass. The range of preferable molecular weight is the same as that described above.

As for preferable latices of styrene/butadiene copolymers according to the invention, mentioned are those from P-3 to P-8, P-14 and P-15 described above, and LACSTAR-3307B, 7132C and Nipol Lx416 which are commercially available.

To the layer containing the organic silver salt of the photosensitive material according to the invention, hydrophilic polymers such as gelatin, polyvinyl alcohol, methyl cellulose, hydroxypropyl cellulose and carboxymethyl cellulose may be added according to necessity.

The addition amount of each of these hydrophilic polymers, based on an entire binder quantity in the layer containing the organic silver salt, preferably 30% by mass or less, and more preferably 20% by mass or less.

It is preferable that the layer containing the organic silver salt (i.e., the image forming layer) according to the invention is formed by using a polymer latex as a binder. As for the amount of the binder in the layer containing the organic silver salt, the weight ratio of the entire binder/organic silver salt is preferably in the range or from 1/10 to 10/1, and more preferably in the range of from 1/5 to 4/1.

In general, such layer containing the organic silver salt is simultaneously a photosensitive layer (emulsion layer) in which a photosensitive silver halide is contained as a photosensitive silver salt. In such a case, the weight ratio of an entire binder/silver halide is preferably in the range of from 5 to 400, and more preferably in the range of from 10 to 200.

The entire amount of the binder in the image forming layer recited in the invention is preferably in the range of from 0.2 g/m$^2$ to 30 g/m$^2$, and more preferably in the range of from 1 g/m$^2$ to 15 g/m$^2$. To the image forming layer according to the invention, a cross-linking agent for executing cross-linking, a surfactant for improving coating properties and the like may be added.

According to the invention, the solvent (for the purpose of simplicity, both of a solvent and a dispersing medium are expressed as a solvent) of a coating solution for the layer containing the organic silver salt of the photosensitive material is preferably an aqueous solvent containing 30% by mass or more of water. As a component other than water, an water-mixable organic solvents such as methyl alcohol, ethyl alcohol, isopropyl alcohol, methyl cellosolve, ethyl cellosolve, dimethyl formamide, ethyl acetate and the like may optionally be used. The water content of the solvent is preferably 50% by mass or more, and more preferably 70% by mass or more.

Examples of preferable solvent compositions include, water, water/methyl alcohol=90/10, water/methyl alcohol=70/30, water/methyl alcohol/dimethyl formamide=80/15/5, water/methyl alcohol/ethyl cellosolve=85/10/5 and water/methyl alcohol/isopropyl alcohol=85/10/5 (numerical values are represented in terms of "% by mass").

1-7. Antifoggant

According to the invention, the photosensitive material preferably contains a compound represented by the following general formula (H) as an antifoggant:

$$Q\text{-}(Y)n\text{-}C(Z_1)\text{-}(Z_2)X \qquad \text{General formula (H)}$$

wherein, Q represent an alkyl group, an aryl group or a heterocyclic group;

Y represents a divalent linking group;

n represents 0 or 1;

$Z_1$ and $Z_2$ each independently represent a halogen atom; and

X represents a hydrogen atom or an electron-attracting group.

In the general formula (H), Q preferably represents a phenyl group substituted by an electron-attracting group having a positive value of the Hammet's substituent constant σp. Regarding the Hammet's substituent constant, Journal of Medicinal Chemistry, 1973, Vol. 16, No.11, pp. 1207 to 1216 can be referenced.

Examples of such electron-attracting groups include a halogen atom (a fluorine atom (σp value: 0.06)), a chlorine atom (σp value: 0.23), a bromine atom (σp value: 0.23) and an iodine atom (σp value: 0.18)), a trihalomethyl group (a tribromomethyl group (σp value: 0.29), a trichloromethyl group (σp value: 0.33) and a trifluoromethyl group (σp value: 0.54)), a cyano group (σp value: 0.66), a nitro group (σp value: 0.78), an aliphatic, aryl or a heterocyclic sulfonyl group (for example, a methane sulfonyl group (σp value: 0.72)), an aliphatic, aryl or a heterocyclic acyl group (for example, an acetyl group (σp value: 0.50) and a benzoyl group (σp value: 0.43)), an alkynyl group (for example, C≡CH (σp value: 0.23)), an aliphatic, aryl or a heterocyclic oxycarbonyl group (for example, a methoxycarbonyl group (σp value: 0.45) and a phenoxycarbonyl group (σp value; 0.44)), a carbamoyl group (σp value: 0.36), a sulfamoyl group (σp value: 0.57), a sulfoxide group, a heterocyclic group and a phosphoryl group. A σp value is preferably in the range of from 0.2 to 2.0, and more preferably in the range of from 0.4 to 1.0.

Particularly preferable electron-attracting groups are a carbamoyl group, an alkoxycarbonyl group, an alkylsulfonyl group, an alkylphosphoryl group, a carboxyl group, an alkylcarbonyl, an arylcarbonyl group, and an arylsulfonyl group. Particularly preferable groups are a carbamoyl group, an alkoxycarbonyl group, an alkylsulfonyl group, and an alkylphosphoryl group. Most preferable group is a carbamoyl group.

In the general formula (H), X is preferably an electron-attracting group, and more preferably a halogen atom, an aliphatic, aryl or a heterocyclic sulfonyl group, an aliphatic, aryl or a heterocyclic acyl group, an aliphatic, aryl or a heterocyclic oxycarbonyl group, a carbamoyl group or a sulfamoyl group. A halogen atom is particularly preferred. Among such halogen atoms, a chlorine atom, a bromine atom and an iodine atom are preferable; a chlorine atom and a bromine atom are more preferable; and a bromine atom is particularly preferable.

In the general formula (H), Y represents preferably —C(═O)—, —SO—, or —$SO_2$—, more preferably —C(═O)— or —$SO_2$—, and particularly preferably —$SO_2$—.

In the general formula (H), n represents 0 or 1 and, preferably, 1.

Specific examples of compounds represented by the general formula (H) according to the invention are described below; however, the invention is by no means limited by the examples.

(H-1)

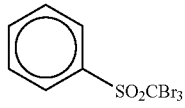

(H-2)

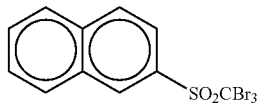

(H-3)

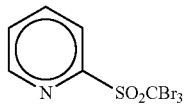

-continued
(H-4)
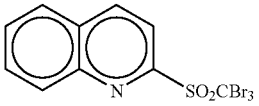
(H-5)
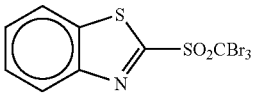
(H-6)
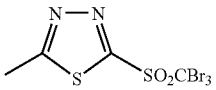
(H-7)
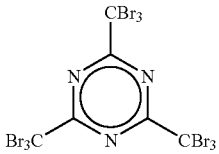
(H-8)
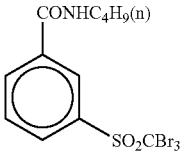
(H-9)
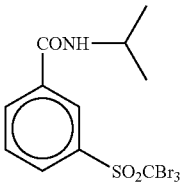
(H-10)
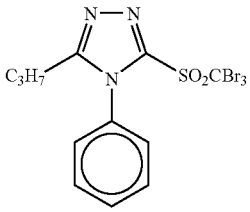
(H-11)
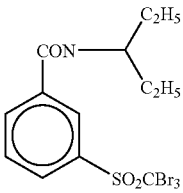
(H-12)
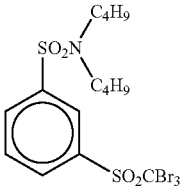
-continued
(H-13)
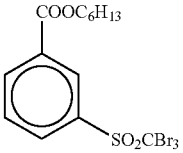
(H-14)
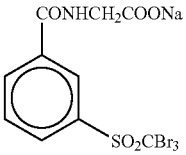
(H-15)
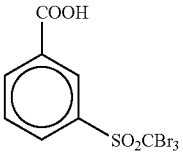
(H-16)
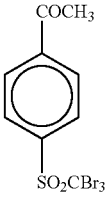
(H-17)
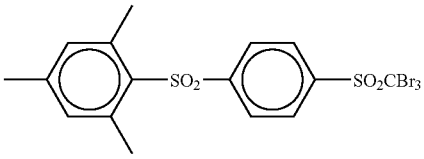
(H-18)
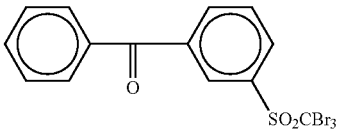
(H-19)
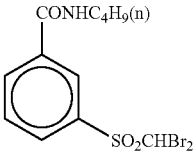
(H-20)
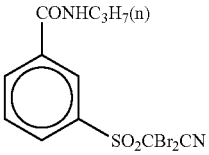
(H-21)
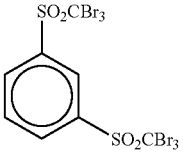

-continued (H-22)

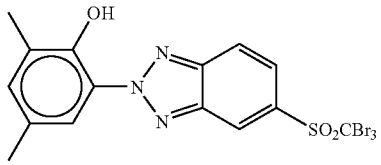

(H-23)

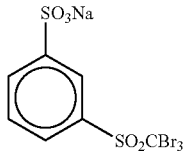

(H-24)

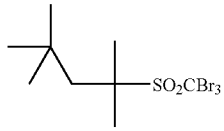

The compound represented by the general formula (H) recited in the invention is used preferably in an amount of $1\times10^{-4}$ mol to 0.8 mol, more preferably from $1\times10^{-3}$ mol to 0.1 mol, and still more preferably from $5\times10^{-3}$ mol to 0.05 mol, per 1 mol of non-photosensitive silver salt in the image forming layer.

As for the method for adding the compound represented by the general formula (H) recited in the invention to the photosensitive material, the same methods as those described in the case of the reducing agent are applicable.

The melting point of the compound represented by the general formula (H) is preferably 200° C. or less and more preferably 170° C. or less.

As for other organic polyhalogen compounds used according to the invention, compounds disclosed in patents described in paragraphs [0111] to [0112] of JP-A No. 11-65021 are cited. Organic halogen compounds represented by the formula (P) in JP-A No. 2000-284399, organic polyhalogen compounds represented by the general formula (II) in JP-A No. 10-339934 and organic polyhalogen compounds described in JP-A No. 2001-033911 are particularly preferable.

1-8. Other Antifoggants

As for other antifoggants, a mercury (II) salt as described in paragraph [0113] of JP-A No. 11-65021, benzoic acids as described in paragraph [0114] of JP-A No. 11-65021, a salicylic acid derivative as described in JP-A No. 2000-206642, a formalin scavenger compound represented by the formula (S) in JP-A No. 2000-221634, a triazine compound related to claim 9 of JP-A No. 11-352624, compounds represented by the general formula (III) of JP-A No. 6-11791, 4-hydoxy-6-methyl-1,3,3a,7-tetrazaindene and the like are mentioned.

As for antifoggants, stabilizers and stabilizer precursors according to the invention, those disclosed as patents described in paragraph [0070] of JP-A No. 10-62899, pp. 20 (line 57) to 21 (line 7) of EP-A No. 0803764, and compounds described in JP-A Nos. 9-281637 and 9-329864 are mentioned.

The photothermographic material according to the invention may contain an azolium salt for the purpose of inhibiting fogging. As for such azolium salts, compounds represented by the general formula (XI) as described in JP-A No. 59-193447, compounds described in Japanese Patent Publication (JP-B) No. 55-12581, and compounds represented by the general formula (II) as described in JP-A No. 60-153039 can be cited. The azolium salt may be added in any part of the photosensitive material. As for a layer to which the azolium salt is added, the layer on a surface having the photosensitive layer is preferable, and the layer containing the organic silver salt is more preferable.

The azolium salt can be added at any step in the preparation of a coating solution. When the azolium salt is added to the layer containing the organic silver salt, the azolium salt may be added in any step of from the preparation of the organic silver salt to the preparation of a coating solution. The azolium salt is preferably added during a period of from the completion of the preparation of the organic silver salt to immediately before the coating. As for the methods for adding the azolium salt, any addition method may be adopted, such as that in a powder state, a solution state or a fine particle dispersion state. The azolium salt may also be added in a state of solution mixed with other additives such as a sensitizing dye, the reducing agent and a color toning agent.

According to the invention, the addition amount of the azolium salt may be any amount. The addition amount is preferably in the range of from $1\times10^{-6}$ mol to 2 mol, and more preferably in the range of from $1\times10^{-3}$ mol to 0.5 mol, per 1 mol of silver.

1-9. Other Additives

1) Mercapto, Disulfide, and Thiones

According to the invention, for the purposes of controlling development by inhibiting or accelerating development, improving spectral sensitization efficiency and also improving shelf-stability before and after the development, a mercapto compound, a disulfide compound and a thione compound can be incorporated. Compounds as described in paragraphs [0067] to [0069] of JP-A No. 10-62899, compounds represented by the general formula (I) and their specific examples as described in paragraphs [0033] to [0052] of JP-A No. 10-186572, compounds described in page 20, lines 36 to 56 of EP-A No. 0803764, and compounds as described in JP-A No. 2001-100358 can be cited. Among them, mercapto-substituted heteroaromatic compounds are preferable.

2) Color Toning Agent

In the photothermographic material according to the invention, a color toning agent is preferably added. Such color toning agents are described in paragraphs [0054] to [0055] of JP-A No. 10-62899, page 21, lines 23 to 48 of EP-A No. 0803764, JP-A No. 2000-356317 and Japanese Patent Application No. 2000-187298. In particular, phthalazinones (phthalazinone, phthalazinone derivatives or their metal salts, for example, 4-(1-naphthyl) phthalazinone, 6-chlorophthalazinone, 5,7-dimethoxy phthalazinone and 2,3-dihydro-1,4-phthalazinedione); combinations of phthalazinones and phthalic acids (for example, phthalic acid, 4-methylphthalic acid, 4-nitrophthalic acid, diammonium phthalate, sodium phthalate, potassium phthalate and tetrachlorophthalic acid anhydride); phthalazines (phthalazine, phthalazine derivatives or their metal salts, for example, 4-(1-naphthyl) phthalazine, 6-isopropylphthalazine, 6-t-butylphthalazine, 6-chlorophthalazine, 5,7-dimethoxyphthalazine and 2,3-dihydrophthalazine) are preferable whereupon, in combinations with a silver halide having a high silver iodide content, combinations of phthalazines and phthalic acids are particularly preferred.

The addition amount of the phthalazine is, per 1 mol of the organic silver salt, preferably from 0.01 mol to 0.3 mol, more preferably from 0.02 mol to 0.2 mol, and particularly preferably from 0.02 mol to 0.1 mol. Such addition amount is an important factor for development acceleration which is a problem of a silver halide emulsion, recited in the invention, having a composition high in silver iodide content. Sufficient developing properties and low fogging can be achieved simultaneously by selecting an appropriate addition amount.

3) Plasticizer and Lubricant

Plasticizers and lubricants employable in the photosensitive layer recited in the invention are described in paragraph [0117] of JP-A No. 11-65021. Sliding agents are described in paragraphs [0061] to [0064] of JP-A No. 11-84573, and paragraphs [0049] to [0062] of JP-A No. 2000-47083.

4) Dye and Pigment

From the standpoint of improving color tones, preventing an interference fringe pattern to be generated by laser light exposure, and preventing irradiation, various types of dyes and pigments (for example, C. I. Pigment Blue 60, C. I. Pigment Blue 64, and C. I. Pigment Blue 15:6) can be used in the photosensitive layer recited in the invention. These dyes and pigments are described in detail in WO98/36322, JP-A No. 10-268465, and 11-338098.

5) Ultra-Hard Gradation Enhancing Agent

For the purpose of forming an ultra-hard gradation image appropriate for an application to a printing plate, an ultra-hard gradation enhancing agent is preferably added to an image forming layer. As for such ultra-hard gradation enhancing agents, the addition methods thereof and the addition amount thereof, compounds described in paragraph [0118] of JP-A No. 11-65021, and paragraphs [0136] to [0193] of JP-A No. 11-223898, compounds represented by the formula (H), the formulae (1) to (3) and the formulae (A) and (B) in JP-A No. 2000-284399, and compounds represented by the general formulae (III) to (V) in Japanese Patent Application No. 11-91652 (specifically, compounds denoted by Chemicals 21 to 24) can be referenced. Further, hard gradation accelerators are also described in paragraph [0102] of JP-A No. 11-65021, and paragraph [0194] to [0195] of JP-A No. 11-223898.

When formic acid or a salt thereof is used as a strong fogging substance, the fogging substance is contained in a layer on the side of the support having the image forming layer containing the photosensitive silver halide, preferably in an amount of 5 millimol or less, and more preferably in an amount of 1 millimol or less, per 1 mol of silver.

When the ultra-hard gradation enhancing agent is used in the photothermographic material recited in the invention, it is preferable to use an acid formed by hydration of phosphorus pentoxide or a salt thereof in combination with the ultra-hard gradation enhancing agent. As for such acids formed by hydration of phosphorus pentoxide or the salts thereof, mentioned are metaphosphoric acid (and salts thereof), pyrophosphoric acid (and salts thereof, orthophosphoric acid (and salts thereof, triphosphoric acid (and salts thereof), tetraphosphoric acid (and salts thereof), and hexametaphosphoric acid (and salts thereof). Particularly preferable acids formed by hydration of phosphorus pentoxide or the salts thereof are orthophosphoric acid (and salts thereof) and hexametaphosphoric acid (and salts thereof). Specific examples of the salts include sodium orthophosphate, sodium dihydrogen orthophosphate, sodium hexametaphosphate and ammonium hexametaphosphate.

The amount of the acid formed by hydration of phosphorus pentoxide or the salt thereof to be used (in terms of a coated amount per 1 $m^2$ of the photosensitive material) may be a desired quantity, depending on properties of sensitivity, fog, and the like. It is preferably from 0.1 $mg/m^2$ to 500 $mg/m^2$, and more preferably from 0.5 $mg/m^2$ to 100 $mg/m^2$.

1-9. Preparation of Coating Solution

The temperature at which the coating solution for the image forming layer recited in the invention is prepared is preferably from 30° C. to 65° C., more preferably from 35° C. to less than 60° C., and still more preferably from 35° C. to 55° C. It is also preferable that the temperature of the coating solution for the image forming layer immediately after addition of the polymer latex is maintained in the range of from 30° C. to 65° C.

2. Other Layers, and Components thereof

The photothermographic material recited in the invention may contain a non-photosensitive layer in addition to the image forming layer. The non-photosensitive layer can be classified according to its position as follows; (a) a surface protective layer formed on the image forming layer (on a farther side from a support), (b) an intermediate layer formed between a plurality of image forming layers or between the image forming layer and the protective layer, (c) an undercoat layer formed between the image forming layer and the support, and (d) a back layer formed on the opposite side of the image forming layer.

Further, a layer acting as an optical filter can be formed in the photosensitive material as a layer classified in (a) or (b). An antihalation layer is formed in the photosensitive material as a layer classified in (c) or (d).

1) Surface Protective Layer

The photothermographic material recited in the invention may have a surface protective layer for the purpose of preventing adhesion of the image forming layer and the like. The surface protective layer may be of a single layer or of a plurality of layers. Such surface protective layers are described in paragraphs [0119] to [0120] of JP-A No. 11-65021, and JP-A No. 2001-348546.

As for binders for the surface protective layer according to the invention, gelatin is preferably used, and polyvinyl alcohol (PVA) is also preferably used solely or in combination with gelatin. As for gelatin, inert gelatin (for example, Nitta Gelatin 750), phthalated gelatin (for example, Nitta Gelatin 801) and the like can be used.

As for PVA, those described in paragraphs [0009] to [0020] of JP-A No. 2000-171936 can be cited. PVA-105 as a completely saponified PVA, PVA-205 as a partly saponified PVA, PVA-335, and MP-203 as a modified polyvinyl alcohol (these are manufactured by Kuraray Co., Ltd.) are preferably mentioned.

The coating amount (per 1 $m^2$ of the support) of polyvinyl alcohol of the protective layer (per one layer) is preferably from 0.3 $g/m^2$ to 4.0 $g/m^2$, and more preferably from 0.3 $g/m^2$ to 2.0 $g/m^2$.

The coating amount (per 1 $m^2$ of the support) of the entire binder (inclusive of water-soluble polymer and latex polymer) of the surface protective layer (per one layer) is preferably from 0.3 $g/m^2$ to 5.0 $g/m^2$, and more preferably from 0.3 $g/m^2$ to 2.0 $g/m^2$.

2) Antihalation Layer

In the photothermographic material according to the invention, an antihalation layer can be formed at the farther side from a light source with respect to the photosensitive layer. Such antihalation layers are described in paragraphs

[0123] to [0124] of JP-A No. 11-65021, JP-A Nos. 11-223898, 9-230531, 10-36695, 10-104779, 11-231457, 11-352625, and 11-352626.

The antihalation layer contains an antihalation dye having an absorption in an exposure wavelength. When such exposure wavelength is in an infrared region, a dye absorbing an infrared ray may be used whereupon the dye having no absorption in a visible wavelength region is preferred.

When antihalation is performed by using a dye having absorption in the visible wavelength region, it is preferred that color of the dye does not remain substantially after an image is formed. A method of decolorizing the dye by the heat in the thermal development is used. A thermally decolorizable dye and a base precursor are preferably added to the non-photosensitive layer to allow the resultant non-photosensitive layer to function as an antihalation layer. Such techniques are described in JP-A No. 11-231457 and the like.

The addition amount of the decolorizable dye is determined depending on applications of the dye. In general, the decolorizable dye is used in such an amount as the optical density (absorbance) measured at the objective wavelength exceeds 0.1. The optical density is preferably in the range of from 0.2 to 2. The amount of the decolorizable dye for obtaining the above-described optical density is ordinarily in the range of from about 0.001 $g/m^2$ to about 1 $g/m^2$.

When the dye is decolorized in such a way, the optical density after thermal development can be lowered to 0.1 or less. Two or more types of decolorizable dyes may be used in combination in a thermally decolorizable-type recording material or in the photothermographic material. In a similar way, two or more types of base precursors may be used in combination.

In the thermal declorization using such a decolorizable dye and base precursor as described above, it is preferable from the viewpoint of thermal declorization properties that a substance (for example, diphenylsulfone, or 4-chlorophenyl (phenyl) sulfone) which decreases the melting point by 3° C. or more when mixed with the base precursor as described in JP-A No. 11-352626 is simultaneously used.

3) Back Layer

Back layers applicable to the invention are described in paragraphs [0128] to [0130] of JP-A No. 11-65021.

According to the invention, a coloring agent having an absorption maximum in the wavelength region of from 300 nm to 450 nm can be added for the purposes of improving silver color tone and suppressing the change of the image over time. Such coloring agents are described in, for example, JP-A Nos. 62-210458, 63-104046, 63-103235, 63-208846, 63-306436, 63-314535, 1-61745, and 2001-100363.

Ordinary, the coloring agents are added in an amount of 0.1 $mg/m^2$ to 1 $g/m^2$ and, as a layer to be added, a back layer provided on the opposite side to the photosensitive layer is preferred.

4) Matting Agent

According to the invention, it is preferred to add a matting agent to the surface protective layer and the back layer for improving transportation properties. Such matting agents are described in paragraphs [0126] to [0127] of JP-A No. 11-65021. The coating amount of the matting agent is, per 1 $m^2$ of the photosensitive material, preferably from 1 $mg/m^2$ to 400 $mg/m^2$, and more preferably from 5 $mg/m^2$ to 300 $mg/m^2$.

Further, as a matting degree on an emulsion surface, any degree is permissible so far as a so-called star dust-like defect in which a small white blank area is generated in an image portion does not occur. A Beck's degree of smoothness is preferably in the range from 30 seconds to 2000 seconds, and particularly preferably in the range of from 40 seconds to 1500 seconds. The Beck's degree of smoothness can easily be obtained in accordance with "Kamioyobibanshino bekkushikennshiniyoru heikatudoshikenhouhou" (Testing Method for Smoothness of Paper and Paperboard by Beck's Tester) by the Japanese Industrial Standards (JIS) P8119 and the TAPPI Standard Method T479.

According to the invention, the Beck's degree of smoothness as a matting degree of the back layer is preferably in the range of from 10 seconds to 1200 seconds, more preferably from 20 seconds to 800 seconds, and still more preferably from 40 seconds to 500 seconds.

According to the invention, the matting agent is preferably contained in the outermost surface layer, a layer functioning as the outermost surface layer, or a layer in a neighborhood of the outer surface layer. And the matting agent is preferably contained in a layer functioning as the so-called protective layer.

5) Polymer Latex

A polymer latex can be added in the surface protective layer or the back layer according to the invention. Such polymer latices are described in, for example, "Gousei Jushi emarujon" (Synthetic Resin Emulsion), compiled by Taira Okuda and Hiroshi Inagaki, Kobunshi Kankokai (Polymer Publishing) (1978), "Gousei ratekkusuno ouyou" (Application of Synthesized Latex), compiled by Takaaki Sugimura, Yasuo Kataoka, Soichi Suzuki and Keiji Kasahara, Kobunshi Kankokai (Polymer Publishing) (1993), and Soichi Muroi, "Gousei ratekkusuno kagaku" (Chemistry of Synthesized Latex), Kobunshi Kankokai (Polymer Publishing) (1970). Specific examples of the polymer latices include a latex of a methyl methacrylate (33.5% by mass)/ethyl acrylate (50% by mass)/methacrylic acid (16.5% by mass) copolymer, a latex of a methyl methacrylate (47.5% by mass)/butadiene (47.5% by mass)/itaconic acid (5% by mass) copolymer, a latex of an ethyl acrylate/methacrylic acid copolymer, a latex of a methyl methacrylate (58.9% by mass)/2-ethylhexyl acrylate (25.4% by mass)/styrene (8.6% by mass)/2-hydroxyethyl metacrylate (5.1% by mass)/acrylic acid (2.0% by mass) copolymer, and a latex of a methyl methacrylate (64.0% by mass)/styrene (9.0% by mass)/butylacrylate (20.0% by mass)/2-hydroxyethyl metacrylate (5.0% by mass)/acrylic acid (2.0% by mass) copolymer.

The amount of the polymer latex contained in the surface protective layer or the back layer is, based on the amount of the entire binder (inclusive of water-soluble polymer and latex polymer), preferably from 10% by mass to 90% by mass, and particularly preferably from 20% by mass to 80% by mass.

6) Film Surface pH

The photothermographic material recited in the invention preferably has a film surface pH before the thermal development of 7.0 or less, and more preferably 6.6 or less. A lower limit is not particularly restricted, and can be approximately 3. The most preferable pH is in the range of from 4 to 6.2.

It is preferred from the viewpoint of lowering the film surface pH that an organic acid such as a phthalic acid derivative, a non-volatile acid such as sulfuric acid or a volatile base such as ammonia is used for adjusting the film surface pH. Particularly, ammonia is preferable for achieving a low film surface pH, because ammonia easily vaporizes and can be removed during the coating step or before the thermal development.

Further, it is also preferred that a non-volatile base such as sodium hydroxide, potassium hydroxide or lithium hydroxide is used with ammonia in combination. The measurement methods of the film surface pH are described in paragraph [0123] of JP-A No. 2000-284399.

7) Hardening Agent

A hardening agent may be used in each layer such as the photosensitive layer, the protective layer, the back layer and the like according to the invention. Examples of such hardening agents are found in various methods described in T. H. James, The Theory of the Photographic Process, 4th edition, Macmillan Publishing Co., Inc. (1977), pp. 77 to 87. In addition to compounds such as chrome alum, sodium salt of 2,4-dichloro-6-hydroxy-s-triazine, N,N-ethylene bis(vinylsulfone acetamide) and N,N-propylene bis(vinylsulfone acetamide), polyvalent metal ions described in the above-cited reference, page 78 and the like, polyisocyanates described in U.S. Pat. No. 4,281,060, JP-A No. 6-208193 and the like, epoxy compounds described in U.S. Pat. No. 4,791,042, and vinyl sulfone compounds described in JP-A No. 62-89048 are preferably used.

The hardening agent is added in a form of solution. The addition time of such hardening agent solution into the coating solution for the protective layer is from 180 minutes before coating to immediately before coating, and preferably from 60 minutes before coating to 10 seconds before coating. The mixing methods and mixing conditions for the hardening agent solution are not particularly limited so far as the effects according to the invention are sufficiently obtained.

Specific examples of mixing methods include a mixing method using a tank in which the average staying time calculated from the addition flow rate and the feeding flow rate to a coater is adjusted to be a desired time, and a mixing method using a static mixer described in N. Harnby, M. F. Edwards and A. W. Nienow, "Ekitai kongou gijutu" (Techniques of Mixing Liquids), translated by Koji Takahashi, Nikkan Kogyo Newspaper (1989), Chapter 8.

8) Surfactant

Surfactants applicable to the invention are described in paragraph [0132] of JP-A No. 11-65021.

According to the invention, fluorine-type surfactants may preferably be used. Specific examples of preferable fluorine-type surfactants include compounds as described in JP-A Nos. 10-197985, 2000-19680, 2000-214554. Also, polymeric fluorine-type surfactants as described in JP-A 9-281636 are preferably used. According to the invention, the fluorine-type surfactants as described in Japanese Patent Application No. 2000-206560 are particularly preferable.

9) Antistatic Agent

Further, according to the invention, an antistatic layer containing various types of known metal oxides or electrically conductive polymers may be provided. The antistatic layer may concurrently functions as the above-described undercoat layer, back layer, surface protective layer or the like, or may be provided separately from these layers. The antistatic layer may adopt techniques as described in paragraphs [0135] of JP-A No. 11-65021, JP-A Nos. 56-143430, 56-143431, 58-62646, and 56-120519, paragraphs [0040] to [0051] of JP-A No. 11-84573, U.S. Pat. No. 5,575,957, and paragraphs [0078] to [0084] of JP-A No. 11-223898.

10) Support

As for transparent supports, polyester, particularly, polyethylene terephthalate, which has been subjected to a thermal treatment in the temperature range of from 130° C. to 185° C. in order to relax residual internal stress generated when being biaxially stretched and to eliminate the strain of thermal contraction generated at the thermal development, is preferably used.

In the case of the photothermographic materials for medical use, the transparent support may be colored with a blue dye (for example, Dye-1 as described in JP-A No. 8-240877) or may not be colored.

Specific examples of the supports are described in paragraphs [0134] of JP-A No. 11-65021.

In the supports, undercoat techniques of a water-soluble polyester as described in JP-A No. 11-84574, a styrene-butadiene copolymer as described in JP-A No. 10-186565, vinylidene chloride copolymers as described in JP-A No. 2000-39684, paragraphs [0063] to [0080] of JP-A No. 2000-47083 and the like are preferably applied.

11) Other Additives

To the photothermographic material, an anti-oxidant, a stabilizing agent, a plasticizer, an ultraviolet ray-absorbing agent, a coating assistant, or a solvent as described in paragraph [0133] of JP-A No. 11-65021may further be added. Various types of these additives are added either to the photosensitive layer or to the non-photosensitive layer. Concerning those additives, WO98/36322, EP-A No. 803764, JP-A Nos. 10-186567 and 10-18568 and the like can be referenced.

12) Coating and Drying

The photothermographic material according to the invention may be coated by any method. Various types of coating operations may be used, and specific examples thereof include extrusion coating, slide coating, curtain coating, dip coating, knife coating, flow coating, and extrusion coating using such a kind of hopper as described in U.S. Pat. No. 2,681,294. Extrusion coating or slide coating as described in Stephen F. Kistler and Peter M. Schweizer, "Liquid Film Coating", Chapman & Hall (1997), pp. 399 to 536 is preferably used. In particular, slide coating is preferably used.

Examples of the shapes of the slide coaters to be used for slide coating are described in the above-cited book, pp. 427, FIG. 11b-1. Further, as desired, two or more layers can simultaneously be coated by methods described in the above-cited book, pp. 399 to 536, U.S. Pat. No. 2,761,791 and British Patent No. 837,095.

It is preferable that the coating solution for the layer containing the organic silver salt recited in the invention is a so-called thixotropic fluid. As to the techniques related to this fluid, JP-A No. 11-52509 can be referenced.

The coating solution for the layer containing the organic silver salt according to the invention, preferably has the viscosity of from 400 mPa·s to 100,000 mPa·s, and more preferably in the range of from 500 mPa·s to 20,000 mPa·s at the shearing velocity of 0.1 $S^{-1}$.

Further, a viscosity at the shearing velocity of 1000 $S^{-1}$ is preferably in the range of 1 mPa·s to 200 mPa·s, and more preferably in the range of 5 mPa·s to 80 mPa·s.

It is preferable that the photothermographic material according to the invention is subjected to a thermal treatment immediately after being coated and dried. Particularly, in a case of the photothermographic material in which a water-soluble latex is used as a binder, film strength of a coated film using the photothermographic material is enhanced by the thermal treatment. Thus, the photothermographic material favorably becomes more insensitive to various handling after the thermal treatment. The temperature of the thermal treatment is, in terms of the effective film surface temperature, preferably in the range of from 60° C. to 100° C. while a time period of heating is preferably in the range of from 1 second to 60 seconds. They are more preferably in the range of from 70° C. to 90° C. and in the range of from 2 seconds to 10 seconds, respectively. As to the preferable heating method applicable to the invention, those described in JP-A No. 2002-107872 can be referred.

13) Wrapping Material

It is preferable that the photothermographic material recited in the invention is hermetically packed by a wrapping material having at least one of a low oxygen transmittance and a low moisture transmittance in order to prevent photographic properties from being deteriorated at the time of storage before being used, or prevent a product using the photothermographic material from being curled or curly deformed when the product is in roll form. The oxygen transmittance at 25° C. is preferably 50 ml/atm/$m^2$day or less, more preferably 10 ml/atm/$m^2$day or less, and still more preferably 1.0 ml/atm/$m^2$day or less. The moisture transmittance is preferably 10 g/atm/$m^2$day or less, more preferably 5 g/atm/$m^2$day or less, and still more preferably 1 g/atm/$m^2$day or less. Specific examples of employable wrapping materials in which at least one of the oxygen transmittance and the moisture transmittance is low include those as described in JP-A Nos. 8-254793 and 2000-206653.

14) Other Employable Techniques

As for the techniques employable in the phototermographic materials according to the invention, techniques described in the following references are further cited: EP-A Nos. 803764, and 883022, WO98/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, from 10-186569 to 10-186572, 10-197974, 10-197982, 10-197983, from 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, from 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864, and 2001-348546, Japanese Patent Application No. 2000-187298.

15) Color Image Formation

In a case of the multi-color photothermographic material, respective emulsion layers are, as described in U.S. Pat. No. 4,460,681, ordinarily maintained in a separate manner from one another by being provided with a functional or non-functional barrier layer between any two of the respective emulsion layers.

Constitution of a multi-color photothermographic material may comprise a combination of such two layers for each color or a single layer containing all the components therein, as described in U.S. Pat. No. 4,708,928.

3. Image Forming Method 3-1. Exposure

The photosensitive material according to the invention may be exposed by any method and preferably exposed with a laser light as an exposure light source.

Particularly when an amount of the exposure which realizes the maximum density (Dmax) is provided, the amount of light on a surface of the photosensitive material is preferably in the range from 0.1 W/$mm^2$ to 100 W/$mm^2$, more preferably in the range of from 0.5 W/$mm^2$ to 50 W/$mm^2$, and most preferably in the range of from 1 W/$mm^2$ to 50 W/$mm^2$.

As for the laser light applicable to the invention, a gas laser ($Ar^+$, He—Ne, or He—Cd), a YAG laser, a dye laser, a semiconductor laser and the like are preferable. Further, a combination of the semiconductor laser with a second harmonic generating element or the like can also be used. Preferable laser, although being determined in correspondence with the maximum absorption wavelength of the spectral sensitizing dye or the like of the photothermographic material, is He—Ne laser or red semiconductor laser which radiates red to infrared light, or Ar+, He—Ne, He—Cd laser, or blue semiconductor laser which radiates blue to green light. In recent years, particularly, a module fabricated by unifying the SHG (Second Harmonic Generator) element with the semiconductor laser, or the blue semiconductor laser has been developed, thereby rapidly attracting people's attention to a laser output device in a short wavelength region. Since the blue semiconductor laser is capable of performing ultra-fine image recording, increasing a recording density and obtaining a long-life and stable output, it is expected that demand for the blue semiconductor laser will be increased.

The laser light is favorably used in a manner in which it is oscillated in a vertical multi-mode by a method such as a high frequency superimposition method.

3-2. Thermal Development

The photothermographic material according to the invention may be developed by any method. Ordinarily, the temperature of the photothermographic material which has imagewise been exposed is elevated to allow the photothermographic material to be developed. The development temperature is preferably from 80° C. to 250° C., and more preferably from 100° C. to 140° C.

The duration of the development time is preferably from 1 second to 60 seconds, more preferably from 5 seconds to 30 seconds, and particularly preferably from 5 seconds to 20 seconds.

A plate heater system is preferably used as the thermal development process. As for the thermal development process utilizing the plate heater system, processes described in JP-A No. 11-133572 are preferable. These processes use a thermal development apparatus for obtaining a visible image by allowing the photothermographic material, in which a latent image has been formed, to contact with a heating unit in a thermal development part. The heating unit comprises a plate heater and a plurality of pressing rollers arranged along one surface of the plate heater such that they face to the surface. The photothermographic material is allowed to pass through between the pressing rollers and the plate heater to be thermally developed. It is preferable that the plate heater is divided into 2 to 6 steps, and that the top step has a temperature lowered by approximately 1° C. to 10° C.

Such methods are also described in JP-A No. 54-30032. According to these methods, moisture and organic solvents contained in the photothermographic material can be removed out of a system, and deformation of the support of the photothermographic material caused by rapid heating can also be suppressed.

3-3. System

As a laser imager having an exposure part and a thermal development part for the medical use, Fuji Medical Dry Imager FM-DP L can be mentioned. Such system is described in Fuji Medical Review No. 8, pp. 39 to 55 and techniques described therein can be utilized. Further, the photothermographic material according to the invention can also be applied as a photothermographic material for the laser imager in "AD network" proposed by Fuji Medical System as a network system adapted to DICOM Standards.

4. Application

The photothermographic material according to the invention forms a black-and-white image based on a silver image; hence, it is preferred that the photothermographic material is used as a photothermographic material for medical diagnosis, as a photothermographic material for industrial photography, as a photothermographic material for printing use, and as a photothermographic material for COM use.

EXAMPLES

Hereinafter, specific examples are given below to illustrate the invention. However, these example should not be interpreted as limiting the invention in any way.

Example 1

1. Preparation of PET Support and Undercoating

1) Film Forming

PET having the intrinsic viscosity IV=0.66 (measured at 25° C. in phenol/tetrachlorethane=6/4 (ratio by weight)) was obtained in accordance with an ordinary preparation method by using terephthalic acid and ethylene glycol. After the thus-obtained PET is pelletized, the resultant pellets were dried at 130° C. for 4 hours. After being melted at 300° C., the thus-melted PET was extruded from a T-type die, and rapidly quenched, thereby preparing an unstretched film having a film thickness of 175 μm after thermal fixation.

The thus-prepared film was stretched up to 3.3 times in the machine direction with rollers having different peripheral velocities, then up to 4.5 times in the transverse direction by means of a tenter. The temperatures at the time of such stretching were 110° C. and 130° C. in the above sequence. Subsequently, the thus-stretched film was subjected to thermal fixation at 240° C. for 20 seconds and, then, to relaxation by 4% in the transverse direction at the same temperature as at the thermal fixation. Thereafter, chucking parts of the tenter were slit off, and both edges of the film were subjected to knurl processing. The film was rolled at 4 kg/cm$^2$ to obtain a roll of film having a thickness of 175 μm.

2) Corona Discharge Surface Treatment

Both surfaces of the support were treated at room temperature at the web handling velocity of 20 m/min by using a solid-state corona discharge processor Model 6KVA manufactured by Pillar Co. From values of electric current and voltage read at that time, it was found that a treatment of 0.375 kV·A·min/m$^2$ was applied to the support. The treatment frequency was 9.6 kHz and the gap clearance between the electrode and the dielectric roll was 1.6 mm.

3) Undercoating 3-1) Preparation of Coating Solution for Undercoat Layer

| | |
|---|---|
| Prescription-1 (For Undercoat Layer on Photosensitive Layer Side) | |
| Pesresin A-520 (30% by mass solution) manufactured by Takamatsu Oil & Fat, Inc. | 59 g |
| Polyethylene glycol monononylphenyl ether (average number of ethylene oxide = 8.5) 10% by mass solution | 5.4 g |
| MP-1000 (polymeric fine particles; average particle diameter: 0.4 μm) manufactured by Soken Kagaku Co., Ltd. | 0.91 g |
| Distilled water | 935 ml |
| Prescription-2 (For First Layer on Back Surface) | |
| Styrene/butadiene copolymer latex (solid content: 40% by mass; weight ratio of styrene/butadiene = 68/32) | 158 g |
| Sodium salt of 2,4-dichloro-6-hydroxy-s-triazine (8% by mass aqueous solution) | 20 g |
| Sodium laurylbenzene sulfonate (1% by mass aqueous solution) | 10 ml |
| Distilled water | 854 ml |
| Prescription-3 (For Second Layer on Back Surface) | |
| $SnO_2$/SbO (9/1 mass ratio; average particle diameter: 0.038 μm; 17% by mass dispersion) | 84 g |
| Gelatin (10% by mass aqueous solution) | 89.2 g |
| Metolose TC-5 (2% by mass aqueous solution) manufactured by Shin-Etsu Chemical Co., Ltd. | 8.6 g |
| MP-1000 manufactured by Soken Kagaku Co., Ltd. | 0.01 g |
| Sodium dodecylbenzene sulfonate (1% by mass aqueous solution) | 10 ml |
| NaOH (1% by mass) | 6 ml |
| Proxel manufactured by ICI Co., Ltd. | 1 ml |
| Distilled water | 805 ml |

3-2) Undercoating

After the corona discharge treatment was performed on both surfaces of a biaxially stretched polyethylene terephthalate support having a thickness of 175 μm, the coating solution of Prescription-1 for the undercoat layer was coated on one surface (photosensitive layer surface) thereof by means of a wire-bar in a wet coated amount of 6.6 ml/m$^2$ (per one surface) and dried at 180° C. for 5 minutes. Then, the coating solution of Prescription-2 for the undercoat layer was coated on the opposite surface (back surface) by means of a wire-bar in a wet coated amount of 5.7 ml/m$^2$ and dried at 180° C. for 5 minutes. Further, the coating solution of Prescription-3 for the undercoat layer was coated on the surface (back surface) by means of a wire-bar in a wet coated amount of 7.7 ml/m$^2$ and dried at 180° C. for 6 minutes to prepare an undercoated support.

2. Back Layer 2-1. Preparation of Coating Solution for Back Layer

1) Preparation of Solid Fine Particle Dispersion (a) of Base Precursor 1.5 kg of a Base Precursor Compound-1, 225 g of DEMOL N (trade name; manufactured by Kao Corporation), 937.5 g of diphenylsulfone, 15 g of parahydroxybenzoic acid methyl ester (trade name: Mekkings M; manufactured by Ueno Fine Chemicals Industry, Ltd.) and distilled water were mixed to make up the entire weight to be 5.0 kg. The resultant mixture was dispersed by using a horizontal-type sand mill (trade name: UVM-2; manufactured by Imex Co., Ltd.). Dispersion conditions were such that the resultant mixture in a solution state was transferred into the UVM-2 filled with zirconia beads having an average particle diameter of 0.5 mm by a diaphragm pump and allowed to be continuously dispersed therein under the inner pressure of 50 hPa or more until allowed to reach a desired degree of dispersion. The degree of dispersion was indicated by the absorbance ratio of 450 nm against 650 nm (D450/D650). The dispersion was continued until the ratio reached 2.2 or more. After the dispersion was performed, the resultant dispersion was diluted with distilled water to putting a concentration of the base precursor down to be 20% by wt and, then, allowed to go through a filter (average pore diameter: 3 μm; material: polypropylene) for the purpose of removing dust.

2) Preparation of Dye Solid Fine Particle Dispersion (a)

6.0 kg of Cyanine Dye Compound-1, 3.0 kg of sodium p-dodecylbenzene sulfonate, 0.6 kg of DEMOL SMB (trade name; manufactured by Kao Corporation), 0.15 kg of SURFYNOL 104E (trade name; manufactured by Nissin Chemical Co., Ltd.) and distilled water were mixed to make up the entire weight to be 60 kg. The resultant mixture was dispersed by using a horizontal-type sand mill UVM-2 filled with zirconia beads having an average particle diameter of 0.5 mm. Such dispersion was performed until the ratio of absorbance degree (D650/D750) reached 5.0 or more. After the dispersion was performed, the resultant dispersion was diluted with distilled water such that a concentration of the cyanine dye came to be 6% by wt and, then, allowed to go through a filter (average pore diameter: 1 μm; material: polypropylene).

3) Preparation of Coating Solution for Antihalation Layer 30 g of gelatin, 24.5 g of polyacrylamide, 2.2 g of caustic soda with a concentration of 1 mol/L, 2.4 g of monodispersed fine particles of polymethyl methacrylate (average particle diameter: 8 μm; standard deviation of particle diameter: 0.4), 0.08 g of benzoisothiazolinone, 35.9 g of the dye solid fine particle dispersion (a) thus prepared above, 74.2 g of the Solid Fine Particle Dispersion (a) of Base Precursor, 0.6 g of sodium polyethylene sulfonate, 0.21 g of Blue Dye Compound-1, 0.15 g of Yellow Dye Compound-1, 8.3 g of an acrylic acid/ethyl acrylate copolymer latex (copolymerization ratio: 5/95) and water were mixed to make up the entire volume to be 818 ml whereby a coating solution for the antihalation layer was prepared.

4) Preparation of Coating Solutionfor Back Surface Protective Layer

In a vessel maintained at 40° C., 40 g of gelatin, 1.5 g of a liquid paraffin emulsion in terms of liquid paraffin, 35 mg of benzoisothiazolinone, 6.8 g of caustic soda having a concentration of 1 mol/L, 0.5 g of sodium tert-octylphenoxyethoxyethane sulfonate, 0.27 g of sodium polystyrene sulfonate, 2.0 g of N,N-ethylene bis(vinyl sulfone acetamide), 37 mg of a fluorine-type surfactant (F-1), 150 mg of a fluorine-type surfactant (F-2), 64 mg of a fluorine-type surfactant (F-3), 32 mg of a fluorine-type surfactant (F-4), 6.0 g of an acrylic acid/ethylacrylate copolymer (weight ratio of copolymerization: 5/95), 2.0 g of N,N-ethylene bis(vinyl sulfonamide) and water were mixed to make up the entire volume to be 1000 ml whereby a coating solution for the back surface protective layer was prepared.

2-2. Coating of Back Layer

On a back surface side of the thus-undercoated support, the coating solution for the antihalation layer was coated such that a coated amount of gelatin becomes 0.44 g/m$^2$ and the coating solution for the back surface protective layer was coated such that a coated amount of gelatin becomes 1.7 g/m$^2$ and dried to prepare a back layer, wherein the coating of these coating solutions is performed by simultaneous multi-layer coating.

3. Image forming layer and Surface Protective Layer 3-1. Preparation of Material for Coating 1) Silver Halide Emulsion (Preparation of silver Halide Emulsion 1)

To 1,421 ml of distilled water, 3.1 ml of a 1% by mass potassium bromide solution was added and, further, 3.5 ml of sulfuric acid having a concentration of 0.5 mol/L and 31.7 g of phthalated gelatin were added. The resultant mixture was stirred and maintained at 30° C. in a reaction vessel made of stainless steel. Solution A which contains 22.22 g of silver nitrate and was made up to be 95.4 ml with distilled water and Solution B which contains 15.3 g of potassium bromide and 0.8 g of potassium iodide and was made up to be 97.4 ml with distilled water were entirely added at a constant flow rate taking 45 seconds to the foregoing solution. Thereafter, 10 ml of a 3.5% by mass aqueous solution of hydrogen peroxide was added and, further, 10.8 ml of a 10% by mass aqueous solution of benzimidazole was added to prepare a mixture.

To the thus-prepared mixture, Solution C which contains 51.86 g of silver nitrate and made up to be 317.5 ml with distilled water and Solution D which contains 44.2 g of potassium bromide and 2.2 g of potassium iodide and made up to be 400 ml with distilled water were prepared. The Solution C was entirely added at a constant flow rate taking 20 minutes. The Solution D was added according to a controlled double jet method while keeping the pAg value at 8.1. 10 minutes after the additions of Solution C and the Solution D was started, the entire quantity of a potassium salt of iridium (III) hexachloric acid was added such that the concentration thereof in the resultant mixture became $1\times10^{-4}$ mol per 1 mol of silver. Further, five seconds after the addition of Solution C was completed, the entire quantity of an aqueous solution of potassium hexacyanoferrate (II) was added such that the concentration thereof in the resultant mixture became $3\times10^{-4}$ mol per 1 mol of silver. When the pH was adjusted to 3.8 by using sulfuric acid having the concentration of 0.5 mol/L, stirring was stopped to perform precipitation/desalting/washing steps. The pH was adjusted to 5.9 by using sodium hydroxide having the concentration of 1 mol/L, thereby preparing a silver halide dispersion having the pAg value of 8.0.

To the silver halide dispersion while stirred and maintained at 38° C., 5 ml of a 0.34% by mass methanol solution of 1,2-benzoisothiazoline-3-one was added and, after 40 minutes elapsed, heated to 47° C. 20 minutes after such heating, the resultant mixture was added with $7.6\times10^{-5}$ mol per 1 mol of silver, of a methanol solution of sodium benzene thiosulfonate and, further, after 5 minutes elapsed, added with $2.9\times10^{-4}$ mol, per 1 mol of silver, of a methanol solution of tellurium sensitizing agent C and ripened for 91 minutes. Thereafter, the resultant mixture was added with $1.2\times10^{-3}$ mol, per 1 mol of silver, (in terms of the sum of Spectral Sensitizing Dye A and Spectral Sensitizing Dye B) of a methanol solution of Spectral Sensitizing Dye A and Spectral Sensitizing Dye B having the molar ratio of 3:1 thereof and, then, after 1 minute elapsed, added with 1.3 ml of a 0.8% by mass methanol solution of N,N'-dihydroxy-N"-diethylmelamine and, further, after 4 minutes elapsed, added with $4.8\times10^{-3}$ mol per 1 mol of silver, of a methanol solution of 5-methyl-2-mercaptobenzimidazol, $5.4\times10^{-3}$ mol per 1 mol of silver, of a methanol solution of 1-phenyl-2-heptyl-5-mercapto-1,3,4-triazol and $8.5\times10^{-3}$ mol per 1 mol of silver, of an aqueous solution of 1-(3-methylureido)-5-mercaptotetrazole sodium salt to prepare a silver halide emulsion 1.

Grains in the thus-prepared silver halide emulsion were silver iodobromide grains having the average sphere-equivalent diameter of 0.042 μm and uniformly containing 3.5% by mol of iodine in which a variation coefficient of a sphere-equivalent diameter is 20%. Grain size and the like were determined from the average of 1,000 grains by means of an electron microscope. A {100} face ratio in these grains was measured by the Kubelka-Munk method and found to be 80%.

(Preparation of Silver Halide Emulsion 2)

Silver Halide Emulsion 2 was prepared in the same manner as in Silver Halide Emulsion 1 except that the temperature of the solution at the time of the grain formation was changed from 30° C. to 47° C., Solution B was changed to a solution in which 15.9 g of potassium bromide was diluted with distilled water to 97.4 ml in volume, Solution D was changed to a solution in which 45.8 g of potassium bromide was diluted with distilled water to be 400 ml in volume, the addition time of Solution C was changed to 30 minutes and potassium hexacyanoferrate (II) was not added.

The precipitation/desalting/washing/dispersion steps were performed in the same manner as in Silver Halide Emulsion 1. Further, Silver Halide Emulsion 2 was obtained in the same manner as in Silver Halide Emulsion 1 except that $7.5\times10^{-4}$ mol (as the sum of Spectral Sensitizing Dye A and spectral Sensitizing Dye B per 1 mol of silver) of a methanol solution of Spectral Sensitizing Dye A and Spectral Sensitizing Dye B having the molar ratio of 1:1 thereof was used in place of the methanol solution having the molar ratio of 3:1 thereof, the addition amount of Tellurium Sensitizing Agent C was changed to $5.1\times10^{-5}$ mol per 1 mol of silver, the addition amount of the methanol solution of 1-phenyl-2-heptyl-5-mercapto-1,3,4-triazol was changed to $3.3\times10^{-3}$ mol per 1 mol of silver, and the addition amount of the aqueous solution of 1-(3-methylureido)-5-mercaptotetrazole sodium salt was changed to $4.7\times10^{-3}$ mol per 1 mol of silver. Grains in Silver Halide Emulsion 2 were cubic grains of pure silver bromide having the average sphere-equivalent diameter of 80 nm and the variation coefficient of sphere-equivalent diameter of 20%.

(Preparation of Silver Halide Emulsion 3)

Silver Halide Emulsion 3 was prepared in a same manner as in Silver Halide Emulsion 1 except that the temperature of solution at the time of grain formation was changed from 30° C. to 27° C.

The precipitation/desalting/washing/dispersion steps were performed in the same manner as in Silver Halide Emulsion 1. Further, Silver Halide Emulsion 3 was obtained in the same manner as in Silver Halide Emulsion 1 except that $6\times10^{-3}$ mol (as the sum of Spectral Sensitizing Dye A and spectral Sensitizing Dye B per 1 mol of silver), of a solid dispersion (gelatin aqueous solution) of Spectral Sensitizing Dye A and Spectral Sensitizing Dye B having the molar ratio of 1:1 thereof was added in place of the methanol solution thereof having the molar ratio of 3:1 thereof, the addition amount of Tellurium Sensitizing Agent C was changed to $5.2\times10^{-4}$ mol per 1 mol of silver, $5\times10^{-4}$ mol per 1 mol of silver, of bromoauric acid and $2\times10^{-3}$ mol per 1 mol of silver, of potassium thiocyanate were added 3 minutes after Tellurium Sensitizing Agent C was added. Grains in Silver Halide Emulsion 3 were pure silver iodobromide grains which uniformly contain 3.5% by mol of iodine having the average sphere-equivalent diameter of 0.034 μm and the variation coefficient of sphere-equivalent diameter of 20%.

(Preparation of Silver Halide Mixed Emulsion A for Coating Solution)

70% by mass of Silver Halide Emulsion 1, 15% by mass of Silver Halide Emulsion 2 and 15% by mass of Silver Halide Emulsion 3 were mixed and dissolved together to prepare a dispersion and, then, the thus-prepared dispersion was added with $7\times10^{-3}$ mol per 1 mol of silver, of a 1% by mass aqueous solution of benzothiazolium iodide. Further, the resultant mixture was added with water such that the content of silver halide becomes 38.2 g per 1 kg of the emulsion of coating solution, in terms of silver, and also added with 0.34 g per 1 kg of the emulsion of coating solution of 1-(3-methylureido)-5-mercaptotetrazole sodium salt.

2) Preparation of Organic Silver Salt Dispersion (Preparation of Fatty Acid Silver Dispersion A)

87.6 kg of behenic acid (product name: Edenor C22-85R; manufactured by Henkel Co.), 423 L of distilled water, 49.2 L of an aqueous solution of NaOH having the concentration of 5 mol/L and 120 L of t-butyl alcohol were mixed and, then, allowed to react with one another at 75° C. for 1 hour to obtain a sodium behenate solution A. Apart from the sodium behenate solution A, 206.2 L (pH 4.0) of an aqueous solution containing 40.4 kg of silver nitrate was prepared and maintained at 10° C. A reaction vessel charged with 635 L of distilled water and 30 L of t-butyl alcohol was maintained at 30° C. and, then, while sufficiently stirring, charged with the entire amount of the foregoing sodium behenate solution A and the entire amount of the foregoing silver nitrate aqueous solution at a constant flow rate taking 93 minutes 15 seconds and 90 minutes, respectively. At that time, the silver nitrate aqueous solution was solely added for 11 minutes after the addition of the silver nitrate aqueous solution was started. After that, the addition of the sodium behenate solution A was started. For 14 minutes 15 seconds after the addition of the silver nitrate aqueous solution was completed, the sodium behenate solution A was solely added. At that time the temperature inside the reaction vessel was maintained at 30° C. and the solution temperature was maintained constant by means of an external temperature control. Further, piping of the addition system for the sodium behenate solution A was warmed by circulating warm water in the outer part of a double-walled tube so that the solution temperature at the outlet of the addition nozzle tip was adjusted to be 75° C. The piping of the addition system of the aqueous silver nitrate solution was also heat-controlled by circulating cold water in the outer part of a double-walled tube. Positions where the sodium behenate solution A and the aqueous silver nitrate solution were added were arranged symmetrically with respect to the stirring shaft at the center, and the respective heights of the positions were adjusted such that they do not touch the reaction solution.

After the addition of the sodium behenate solution A was completed, the resultant reaction solution was held at a temperature thereof as it was for 20 minutes with stirring and, then, the temperature was elevated up to 35° C. taking 30 minutes. After that, the solution was ripened for 210 minutes. Immediately after such ripening, the solid content was separated by centrifugal filtration and, then, the thus-separated solid content was rinsed with water until electrical conductivity of the filtrate reached 30 μS/cm. Thus, a fatty acid silver salt was obtained. The solid substance obtained in such a manner as described above was stored as a wet cake without drying.

Shapes of silver behenate particles thus obtained were evaluated by electron microscopic photography. The obtained silver behenate particles were scaly crystals having the average values of a=0.14 μm, b=0.4 μm and c=0.6 μm, the average aspect ratio of 5.2, the average sphere-equivalent diameter of 0.52 μm and the variation coefficient of the average sphere-equivalent diameter of 15% (a, b and c were according to respective definitions previously described herein).

19.3 kg of polyvinyl alcohol (trade name: PVA-217; manufactured by Kuraray Co., Ltd.) and water were added to the wet cake corresponding to 260 kg of dry solid content to make up the entire amount to be 1,000 kg and, then, the resultant mixture was changed into slurry by means of dissolver-blades. Further, the slurry was preliminarily dispersed with a pipeline-mixer (Model PM-10; manufactured by Mizuho Industrial Co., Ltd.)

The obtained predispersion thus preliminarily dispersed was processed three times with a high pressure homogenizer-type dispersing machine (trade name: Microfluidizer M-610 equipped with a Z-type interaction chamber; manufactured by Microfluidex International Corporation) under the pressure adjusted to 1,260 kg/cm$^2$ to obtain a silver behenate dispersion A. The dispersion temperature was set at 18° C. by adjusting the temperature of coolant such that a cooling operation was performed by using coiled heat exchangers installed in front and rear of the interaction chamber, respectively.

(Preparation of Fatty Acid Silver Dispersion B)

<Preparation of Recrystllized Behenic Acid>

100 kg of behenic acid (product name: Edenor C22-85R; manufactured by Henkel Co.) was added to 1200 kg of isopropyl alcohol, dissolved therein at 50° C., filtered by a filter of 10 μm, and cooled to 30° C. to be recrystallized. The cooling rate at the time of such cooling was controlled to be 3° C./hour. Such crystal obtained in a manner as described above was subjected to centrifugal filtration, rinsed with 100 kg of isopropyl alcohol by sprinkling, and dried. The thus-dried crystal was esterified and subjected to a GC-FID measurement to find that the content of silver behenate was 96% by mass, that of lignoceric acid was 2% by mass, that of arachidic acid was 2% by mass and that of erucic acid was 0.001% by mass.

<Preparation of Fatty Acid Silver Dispersion B>

88 kg of recrystallized behenic acid, 422 L of distilled water, 49.2 L of an aqueous solution of NaOH having the concentration of 5 mol/L and 120 L of t-butyl alcohol were mixed and, then, allowed to react with one another at 75° C. for 1 hour to obtain a sodium behenate solution B. Apart from the sodium behenate solution B, 206.2 L (pH 4.0) of an aqueous solution containing 40.4 kg of silver nitrate was prepared and maintained at 10° C. A reaction vessel charged with 635 L of distilled water and 30 L of t-butyl alcohol was maintained at 30° C. and, then, while sufficiently stirring, charged with the entire quantity of the foregoing sodium behenate solution B and the entire quantity of the foregoing silver nitrate aqueous solution at a constant flow rate taking 93 minutes 15 seconds and 90 minutes, respectively. At that time, the silver nitrate aqueous solution was solely added for 11 minutes after the addition of the silver nitrate aqueous solution was started. After that, the addition of the sodium behenate solution B was started. For 14 minutes 15 seconds after the addition of the silver nitrate aqueous solution was completed, the sodium behenate solution B was solely added. At that time, the temperature inside the reaction vessel was maintained at 30° C. and the solution temperature was maintained constant by means of an external temperature control. Further, the piping of the addition system for the sodium behenate solution B was warmed by circulating warm water in the outer part of a double-walled tube so that the solution temperature at the outlet of the addition nozzle tip was adjusted to be 75° C. The piping of the addition system of the aqueous silver nitrate solution was also heat-controlled by circulating cold water in the outer part of a double-walled tube. Positions where the sodium behenate solution B and the aqueous silver nitrate solution were added were arranged symmetrically with respect to the stirring shaft at the center, and the respective heights of the positions were adjusted such that they do not touch the reaction solution.

After the addition of the sodium behenate solution B was completed, the resultant reaction solution was held at a temperature thereof as it was for 20 minutes with stirring and, then, the temperature was elevated up to 35° C. taking 30 minutes. After that, the sodium behenate solution B was ripened for 210 minutes. Immediately after such ripening, the solid content was separated by centrifugal filtration and, then, the thus-separated solid content was rinsed with water until electrical conductivity of the filtrate reached 30 μS/cm. Thus, a fatty acid silver salt was obtained. The solid substance obtained in such a manner as described above was stored as a wet cake without drying.

Shapes of silver behenate particles thus obtained were evaluated by electron microscopic photography. The obtained silver behenate particles were scaly crystals having the average values of a=0.21 μm, b=0.4 μm and c=0.4 μm, the average aspect ratio of 2.1, and the variation coefficient of a sphere-equivalent diameter of 11% (a, b and c were according to respective definitions previously described herein).

19.3 kg of polyvinyl alcohol (trade name: PVA-217; manufactured by Kuraray Co., Ltd.) and water were added to the wet cake corresponding to 260 kg of dry solid content to make up the entire amount to be 1,000 kg and, then, the resultant mixture was changed into slurry by means of dissolver-blades. Further, the slurry was preliminarily dispersed with a pipeline-mixer (Model PM-10; manufactured by Mizuho Industrial Co., Ltd.)

Then, the predispersion thus preliminarily dispersed was processed three times with a high pressure homogenizer-type dispersing machine (trade name: Microfluidizer M-610 equipped with a Z-type interaction chamber; manufactured by Microfluidex International Corporation) under the pressure adjusted to 1,150 kg/cm$^2$ to obtain a silver behenate dispersion B. The dispersion temperature was set at 18° C. by adjusting the temperature of coolant such that the cooling operation was performed by using coiled heat exchangers installed in front and rear of the interaction chamber, respectively.

(Annealing Treatment)

20 kg each of the fatty acid silver dispersions A and B was put in a container made of polypropylene. After the container was hermetically sealed, it was stored under the conditions described in Table 1. The thus-stored dispersions were defined as fatty acid silver dispersions Aa to Ag and fatty acid silver dispersions Ba to Bg. When particle size distributions thereof before and after such storage were examined, it was found that there was no change.

TABLE 1

| Condition | Temperature | Time | Remark |
|---|---|---|---|
| a | 5° C. (under refrigeration) | 5 hours | Comparative Example |
| b | 25° C. (at room temperature) | 5 hours | Comparative Example |
| c | 35° C. | 5 hours | Present Invention |
| d | 35° C. | 10 days | Present Invention |
| e | 50° C. | 5 hours | Present Invention |
| f | 65° C. | 5 hours | Present Invention |
| g | 95° C. | 5 hours | Comparative Example |

h: time; d: number of days

3) Preparation of Reducing Agent Dispersion (Preparation of Reducing Agent Complex-1 Dispersion)

10 kg of water was added to 10 kg of Reducing Agent Complex-1, 0.12 kg of triphenylphosphine oxide, 16 kg of a 10% by mass aqueous solution of modified polyvinylalcohol (trade name: POVAL MP203; manufactured by Kuraray Co. Ltd.), and surfactants of the present invention and Comparative Example (types and amounts thereof are shown in Table 1). Then, the resultant mixture was thoroughly mixed to be slurry. The slurry was fed by means of a diaphragm pump into a horizontal-type sand mill (trade name: UVM-2; manufactured by Imex Co., Ltd.) filled with zirconia beads having the average diameter of 0.5 mm, and dispersed for 4 hours 30 minutes. Then, 0.2 g of a sodium salt of benzoisothiazolinone and water were added to the resultant dispersion so as to allow the concentration of the reducing agent complex to be 22% by mass, thereby obtaining Reducing Agent Complex-1 Dispersion. The particles of the reducing agent complex contained in the reducing agent complex dispersion thus obtained had the median particle diameter of 0.45 μm and the maximum particle diameter of 1.4 μm or less. The thus-obtained reducing agent complex dispersion was filtrated with a filter made of polypropylene having the pore diameter of 3.0 μm to remove foreign matters like dusts and, then, stored.

(Preparation of Reducing Agent-2 Dispersion)

10 kg of water was added to 10 kg of Reducing Agent-2, 16 kg of a 10% by mass aqueous solution of modified polyvinylalcohol (trade name: POVAL MP203; manufactured by Kuraray Co. Ltd.), and surfactants of the present invention and Comparative Example (the types and the amounts thereof are shown in Table 1). Then, the resultant mixture was thoroughly mixed to be slurry. The slurry was fed by means of a diaphragm pump into a horizontal-type sand mill (trade name: UVM-2; manufactured by Imex Co., Ltd.) filled with zirconia beads having the average diameter of 0.5 mm, and dispersed for 3 hours 30 minutes. Then, 0.2 g of a sodium salt of benzoisothiazolinone and water were added to the resultant dispersion so as to allow the concentration of the reducing agent to be 25% by mass. The resultant dispersion was heated at 60° C. for 5 hours to obtain the Reducing Agent-2 Dispersion. The particles of the reducing agent contained in the reducing agent dispersion thus obtained had the median particle diameter of 0.40 μm and the maximum particle diameter of 1.5 μm or less. The thus-obtained reducing agent dispersion was filtrated with a filter made of polypropylene having the pore diameter of 3.0 μm to remove foreign matters like dusts and, then, stored.

4) Preparation of Hydrogen bonding compound-1 Dispersion 10 kg of water was added to 10 kg of Hydrogen bonding compound-1, 16 kg of a 10% by mass aqueous solution of modified polyvinylalcohol (trade name: POVAL MP203; manufactured by Kuraray Co., Ltd.), and surfactants according to the present invention and Comparative Example (the types and the amounts are shown in Table 1). Then, the resultant mixture was thoroughly mixed to be slurry. The slurry was fed by means of a diaphragm pump into a horizontal-type sand mill (trade name: UVM-2; manufactured by Imex Co., Ltd.) filled with zirconia beads having the average diameter of 0.5 mm, and dispersed for 3 hours 30 minutes. Then, 0.2 g of a sodium salt of benzoisothiazolinone and water were added to such dispersion so as to allow the concentration of the hydrogen bonding compound to be 25% by mass. The resultant dispersion was heated at 80° C. for one hour to obtain Hydrogen bonding compound-1 Dispersion. Particles of the hydrogen bonding compound contained in the hydrogen bonding compound dispersion thus obtained had the median particle diameter of 0.35 μm and the maximum particle diameter of 1.5 μm or less. The hydrogen bonding compound dispersion was filtrated with a filter made of polypropylene having the pore diameter of 3.0 μm to remove foreign matters like dusts and, then, stored.

5) Preparation of Developing Accelerator-1 Dispersion 10 kg of water was added to 10 kg of Developing Accelerator-1, and 20 kg of a 10% by mass aqueous solution of modified polyvinylalcohol (trade name: POVAL MP203; manufactured by Kuraray Co., Ltd.). Then, the resultant mixture was thoroughly mixed to be slurry. The slurry was fed by means of a diaphragm pump into a horizontal-type sand mill (trade name: UVM-2; manufactured by Imex Co., Ltd.) filled with zirconia beads having the average diameter of 0.5 mm, and dispersed for 3 hours 30 minutes. Then, 0.2 g of a sodium salt of benzoisothiazolinone and water were added to such dispersion so as to allow the concentration of the developing accelerator to be 2.0% by mass, thereby obtaining a Developing Accelerator-1 Dispersion. Particles of the developing accelerator contained in the developing accelerator dispersion thus obtained had the median particle diameter of 0.48 μm and the maximum particle diameter of 1.4 μm or less. The developing accelerator dispersion was filtrated with a filter made of polypropylene having the pore diameter of 3.0 μm to remove foreign matters like dusts and, then, stored.

Solid dispersions of a Developing Accelerator-2 and a Color Tone Controlling Agent-1 were dispersed in the same manner as in the Developing Accelerator-1 to obtain respective 20% by mass dispersions.

6) Preparation of Organic Polyhalogen Compound Dispersion (Preparation of Organic Polyhalogen Compound-1 Dispersion)

14 kg of water was added to 10 kg of Organic Polyhalogen Compound-1, 10 kg of a 20% by mass aqueous solution of modified polyvinylalcohol (trade name: POVAL MP203; manufactured by Kuraray Co., Ltd.), and surfactants according to the present invention and Comparative Example (the types and the amounts are shown in Table 1). Then, the resultant mixture was thoroughly mixed to be slurry. The slurry was fed by means of a diaphragm pump into a horizontal-type sand mill (trade name: UVM-2; manufactured by Imex Co., Ltd.) filled with zirconia beads having the average diameter of 0.5 mm, and dispersed for 5 hours. Then, 0.2 g of a sodium salt of benzoisothiazolinone and water were added to such dispersion so as to allow the concentration of the organic polyhalogen compound to be 26% by mass, thereby obtaining Organic Polyhalogen Compound-1 Dispersion. Particles of the organic polyhalogen compound contained in the organic polyhalogen compound dispersion thus obtained had the median particle diameter of 0.41 μm and the maximum particle diameter of 2.0 μm or less. The organic polyhalogen Compound dispersion obtained was filtrated with a filter made of polypropylene having the pore diameter of 3 μm to remove foreign matters like dusts and, then, stored.

(Preparation of Organic Polyhalogen Compound-2 Dispersion)

10 kg of Organic Polyhalogen Compound-2, 20 kg of a 10% by mass aqueous solution of modified polyvinylalcohol (trade name: POVAL MP203; manufactured by Kuraray Co., Ltd.), and surfactants according to the present invention and Comparative Example (the types and the amounts are shown in Table 1) were thoroughly mixed to be slurry. The slurry was fed by means of a diaphragm pump into a horizontal-type sand mill (trade name: UVM-2; manufactured by Imex Co., Ltd.) filled with zirconia beads having the average diameter of 0.5 mm, and dispersed for 5 hours. Then, 0.2 g of a sodium salt of benzoisothiazolinone and water were added to such dispersion so as to allow the concentration of the organic polyhalogen compound to be 30% by mass. The resultant dispersion was heated at 40° C. for 5 hours to obtain Organic Polyhalogen Compound-2 Dispersion. Particles of the organic polyhalogen compound contained in the organic polyhalogen compound dispersion thus obtained had the median particle diameter of 0.40 μm and the maximum particle diameter of 1.3 μm or less. The organic polyhalogen Compound dispersion obtained was filtrated with a filter made of polypropylene having the pore diameter of 3.0 μm to remove foreign matters like dusts and, then, stored.

7) Preparation of Phthalazine Compound-1 Solution 8 kg of modified polyvinylalcohol (trade name: MP203; manufactured by Kuraray Co., Ltd.) was dissolved in 174.57 kg of water. Then, 3.15 kg of a 20% by mass aqueous solution of sodium triisopropylnaphthalene sulfonate and 14.28 kg of a 70% by mass aqueous solution of Phthalazine Compound-1 (6-isopropylphthalazine) were added to the resultant solution to prepare a 5% by mass solution of Phthalazine Compound-1.

8) Preparation of Mercapto Compound (Preparation of Mercapto Compound-1 Aqueous Solution)

7 g of Mercapto Compound-1 was dissolved in 993 g of water to obtain a 0.7% by mass aqueous solution.

(Preparation of Mercapto Compound-2 Aqueous Solution)

20 g of Mercapto Compound-2 was dissolved in 980 g of water to obtain a 2.0% by mass aqueous solution.

9) Preparation of Pigment-1 Dispersion 250 g of water was added to 64 g of C.I. Pigment Blue 60 and 6.4 g of DEMOL N (manufactured by Kao Corporation). Then, the resultant mixture was thoroughly mixed to be slurry. 800 g of zirconia beads having the average diameter of 0.5 mm was prepared and charged in a vessel together with the slurry. The slurry was dispersed for 25 hours with a dispersing machine (trade name: 1/4 G Sand-Grinder Mill; manufactured by Imex Co., Ltd.) and added with water to allow the concentration of the pigment to be a 5% by mass, thereby obtaining Pigment-1 Dispersion. Pigment particles contained in the pigment dispersion thus obtained had the average particle diameter of 0.21 μm.

10) Preparation of SBR Latex Solution

An SBR latex was prepared in a manner as described below.

287 g of distilled water, 7.73 g of surfactant (trade name: PIONIN A-43-S (solid content: 48.5%); manufactured by Takemoto Oil & Fat Co., Ltd.), 14.06 ml of 1 mol/L NaOH, 0.15 g of tetra sodium ethylene diamine tetraacetate, 255 g of styrene, 11.25 g of acrylic acid, and 3.0 g of t-dodecylmercaptan were loaded in a reaction vessel of a gas monomer reaction apparatus (Model: TAS-2J TYPE; manufactured by Taiatsu Techno Corporation) and, after the vessel was hermetically sealed, stirred at a stirring rate of 200 rpm. The vessel was vacuumized by a vacuum pump and, after being purged with nitrogen gas several times, fed with 108.75 g of 1,3-butadiene with pressure and, then, the temperature inside the vessel was elevated to 60° C. Thereafter, a solution in which 1.875 g of ammonium persulfate was dissolved in water was loaded in the vessel and stirred for 5 hours as it was. The temperature of the resultant content was further elevated to 90° C. and, then, stirred for 3 hours. After the reaction is completed, the inside temperature of the vessel was lowered to room temperature and pH of the content was adjusted to be 8.4 by adding 1 mol/L NaOH and $NH_4OH$ such that the molar ratio of $Na^+$ ion to $NH_4^+$ ion became 1:5.3. Then, the content was filtrated with a filter made of polypropylene having the pore diameter of 1.0 μm to remove foreign matters like dusts and, then, stored whereupon 774.7 g of SBR latex was obtained. When halogen ion was measured by using an ion chromatography, the concentration of chloride ion was 3 ppm. When the concentration of the chelating agent was measured by a high-speed liquid chromatography, the result was 145 ppm.

Properties of thus-obtained latex were as follows: the average particle diameter was 90 nm; Tg=17° C.; solid content is 44% by mass; equilibrium moisture content at 25° C. 60% RH was 0.6% by mass; ionic conductivity was 4.80 mS/cm (as for ionic conductivity, latex starting solution (44% by mass). was measured at 25° C. by using a diagometer (trade name: CM-30S; manufactured by CDKK-TOA Co., Ltd.)); and pH was 8.4.

SBR latices having different Tg's can be prepared in the same manner by only appropriately changing ratios of styrene to butadiene.

3-2. Preparation of Coating Solution

1) Coating Solution for Image forming layer (Preparation of Coating Solutions-1 to -7 for Image forming layer)

1,000 g each of Fatty Acid Silver Salt Dispersions Aa to Ag obtained in a manner as described above, 276 ml of water, 33 g of Pigment-1 Dispersion, 21 g of Organic Polyhalogen Compound-1 Dispersion, 58 g of Organic Polyhalogen Compound-2 Dispersion, 173 g of Phthalazine Compound-1 Solution, 1,082 g of SBR Latex (Tg: 17° C.) Solution, 299 g of Reducing Agent Complex-1 Dispersion, 5.7 g of Developing Accelerator-1 Dispersion, 9 ml of Mercapto Compound-1 Aqueous Solution, and 27 ml of Mercapto Compound-2 Aqueous Solution were added in this order. Immediately before coating, 117 g of Silver Halide Mixed Emulsion A was added to the resultant mixture and thoroughly stirred, thereby obtaining Coating Solutions-1 to −7 for image forming layer. The coating solutions were each fed to a coating die as it was, and coated.

(Preparation of Coating Solutions-8 to -14 for Image forming layer)

1,000 g each of Fatty Acid Silver Salt Dispersions Ba to Bg obtained in a manner as described above, 276 ml of water, 35 g of Pigment-1 Dispersion, 32 g of Organic Polyhalogen Compound-1 Dispersion, 46 g of Organic Polyhalogen Compound-2 Dispersion, 173 g of Phthalazine Compound-1 Solution, 1,082 g of SBR Latex (Tg: 17° C.) Solution, 153 g of Reducing Agent-2 Dispersion, 55 g of Hydrogen bonding compound-1 Dispersion, 4.8 g of Developing Accelerator-1 Dispersion, 5.2 g of Developing Accelerator-2 Dispersion, 2.1 g of Color Tone Controlling Agent-1 Dispersion, and 8 ml of Mercapto Compound-2 Aqueous Solution were added in this order. Immediately before coating, 140 g of Silver Halide Mixed Emulsion A was added to the resultant mixture and thoroughly stirred, thereby obtaining Coating Solutions-8 to −14 for image forming layer. The coating solutions were each fed to a coating die as it was, and coated.

2) Preparation of Coating Solution for Intermediate Layer 27 ml of a 5% by mass aqueous solution of Aerosol TO (manufactured by American Cyanamid Company) and 135 ml of a 20% by mass aqueous solution of diammonium phthalate were added to 1000 g of polyvinyl alcohol (trade name: PVA-205; manufactured by Kuraray Co., Ltd.), 272 g of Pigment-1 Dispersion, and 4200 ml of a 19% by mass solution of a latex of a methyl methacrylate/styrene/butyl acrylate/hydroxyethyl methacrylate/acrylic acid copolymer (copolymerization ratio by weight: 64/9/20/5/2) and were added with water, making the entire quantity of the resultant mixture to be 10000 g. The pH value of the thus-made mixture was adjusted to 7.5 with NaOH, thereby obtaining a coating solution for intermediate layer. The coating solution was fed to a coating die such that the coating quantity became 9.1 ml/m$^2$.

The viscosity of the coating solution was 58 [mPa·s] at 40° C. when measured with a B-type viscometer (No. 1 rotor at 60 rpm).

3) Preparation of Coating Solution for First Layer of Emulsion Surface Protective Layer 64 g of inert gelatin was dissolved in water. To the resultant gelatin solution, added were 112 g of a 19.0% by mass solution of a latex of a methyl methacrylate/styrene/butyl acrylate/hydroxyethyl methacrylate/acrylic acid copolymer (copolymerization ratio by weight: 64/9/20/5/2), 30 ml of a 15% by mass methanol solution of phthalic acid, 23 ml of a 10% by mass aqueous solution of 4-methyl phthalic acid, 28 ml of sulfuric acid having the concentration of 0.5 mol/L, 5 ml of a 5% by mass aqueous solution of Aerosol OT (manufactured by American Cyanamid Company), 0.5 g of phenoxyethanol and 0.1 g of benzoisothiazolinone. Then, water was added to the resultant mixture to make up the entire quantity thereof to be 750 g, thereby obtaining a coating solution. Immediately before coating, the coating solution was mixed with 26 ml of a 4% by mass chrome alum solution by using a static mixer and, then, fed to a coating die such that the coating quantity became 18.6 ml/m$^2$.

Viscosity of the coating solution was 20 [mPa·s] at 40° C. when measured with a B-type viscometer (No. 1 rotor at 60 rpm).

4) Preparation of Coating Solution for Second Layer of Emulsion Surface Protective Layer 80 g of inert gelatin was dissolved in water. To the resultant gelatin solution, added were 102 g of a 27.5% by mass solution of a latex of a methyl methacrylate/styrene/butyl acrylate/hydroxyethyl methacrylate/acrylic acid copolymer (copolymerization ratio by weight: 64/9/20/5/2), 5.4 ml of a 2% by mass solution of a fluorine-type surfactant (F-1), 5.4 ml of a 2% by mass aqueous solution of a fluorine-type surfactant (F-2), 23 ml of a 5% by mass solution of Aerosol TO (manufactured by American Cyanamid Company), 4 g of polymethyl methacrylate fine particles (average particle diameter: 0.7 μm), 21 g of polymethyl methacrylate fine particles (average particle diameter: 4.5 μm), 1.6 g of 4-methyl phthalic acid, 4.8 g of phthalic acid, 44 ml of sulfuric acid having the concentration of 0.5 mol/L, and 10 mg of benzoisothiazolinone. Then, water was added to the resultant mixture to make up the entire quantity thereof to be 650 g, thereby obtaining a mixture. Immediately before coating, the thus-obtained mixture was further added with 445 ml of an aqueous solution containing 4% by mass of chrome alum and 0.67% by mass of phthalic acid by using a static mixer to obtain a coating solution for surface protective layer. The coating solution was fed to a coating die such that the coating amount became 8.3 ml/m$^2$.

The viscosity of the coating solution was 19 [mPa·s] at 40° C. when measured with a B-type viscometer (No. 1 rotor at 60 rpm).

4. Preparation of Coated Sample 4-1. Preparation of Photothermographic Material Samples-1 to -7

On the surface opposite to the back surface, the image forming layer Coating Solutions-1 to -7 (one of them), the intermediate layer, the first layer of the surface protective layer and the second layer of the surface protective layer were coated in a simultaneous multi-layer manner by using a slide bead coating method in this order starting from the undercoated surface to prepare Photothermographic Material Samples-1 to -7. The temperatures, at that time, were adjusted such that the image forming layer and the intermediate layer were maintained at 31° C., the first layer of the surface protective layer was maintained at 36° C. and the second layer of the protective layer was maintained at 37° C.

The coated amount (g/m$^2$) of each compound in the image forming layer is shown below.

| | |
|---|---|
| Silver behenate A | 5.58 |
| Pigment (C.I. Pigment Blue 60) | 0.036 |
| Polyhalogen Compound-1 | 0.12 |
| Polyhalogen Compound-2 | 0.37 |
| Phthalazine Compound-1 | 0.19 |
| SBR latex | 9.98 |
| Reducing Agent Complex-1 | 1.41 |
| Developing Accelerator-1 | 0.025 |
| Mercapto Compound-1 | 0.002 |
| Mercapto Compound-2 | 0.012 |
| Silver halide (in terms of silver) | 0.091 |

Coating and drying conditions are described below.

Coating was performed at a coating speed of 160 m/min. The distance between the tip of the coating die and the support was set in the range of from 0.10 mm to 0.30 mm. Pressure inside the reduced pressure chamber was set lower than the atmospheric pressure by from 196 Pa to 882 Pa. The support was electrically discharged with ionized air before coating.

After the coated solution was chilled in a subsequent chilling zone with air having a dry bulb temperature of from 10° C. to 20° C., the coated support was transported in a non-contact manner, and dried with drying air having a dry bulb temperature of from 23° C. to 45° C. and a wet bulb temperature of from 15° C. to 21° C. by means of a helical non-contact-type drying apparatus.

After being dried, the moisture content of the film surface was conditioned at 25° C., 40% to 60% RH and, then, heated to a temperature of from 70° C. to 90° C. After being heated, the film surface was cooled down to 25° C.

Matting degrees of the prepared photothermographic material were 550 seconds on the side of the surface of the photosensitive layer and 130 seconds on the side of the back surface in terms of Beck's degree of smoothness. When the pH value of the film surface on the side of the photosensitive layer was measured, it was 6.0.

4-2. Preparation of Photothermographic Material Samples-8 to -14

Photothermographic Materials-8 to -14 were prepared in the same manner as in Photothermographic Material-1 except that, with reference to Photothermographic Materials-1 to -7, the coating solutions for the image forming layers were changed to Coating Solutions-8 to -14 for Image forming layer, Yellow Dye Compound-1 was eliminated from the antihalation layer, and the fluorine-type surfactant (F-1) and the fluorine-type surfactant (F-2) in the protective layer for the back surface and the front surface were changed into (F-3) and (F-4), respectively.

At that time, the coated amount (g/m$^2$) of each compound in the image forming layer is shown below.

| | |
|---|---|
| Silver behenate B | 5.27 |
| Pigment (C.I. Pigment Blue 60) | 0.036 |
| Polyhalogen Compound-1 | 0.17 |
| Polyhalogen Compound-2 | 0.28 |
| Phthalazine Compound-1 | 0.18 |
| SBR latex | 9.48 |
| Reducing Agent-2 | 0.77 |
| Hydrogen bonding compound-1 | 0.28 |
| Developing Accelerator-1 | 0.019 |
| Developing Accelerator-2 | 0.020 |
| Color Tone Controlling Agent-1 | 0.008 |
| Mercapto Compound-2 | 0.003 |
| Silver halide (in terms of silver) | 0.091 |

Chemical structures of compounds which are employed in Examples according to the invention are described below.

[kagaku 11]

Spectral Sensitizing Dye A

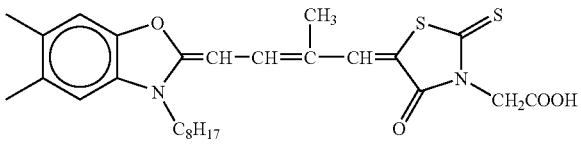

-continued

Spectral Sensitizing Dye B

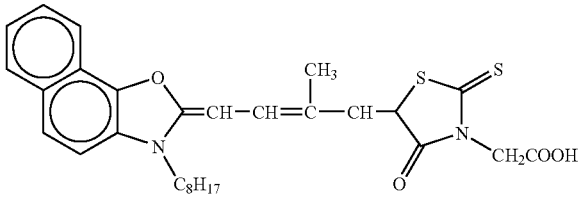

Tellulium Sensitizing Agent C

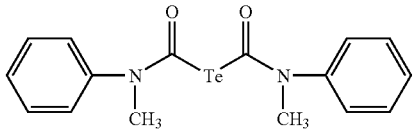

Base Precursor Compound - 1

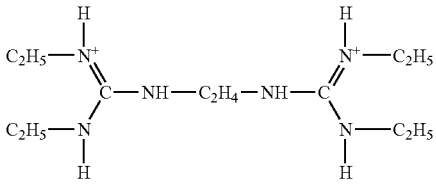

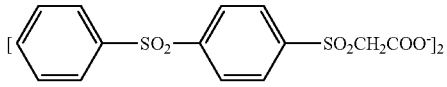

Cyanine Dye Compound - 1

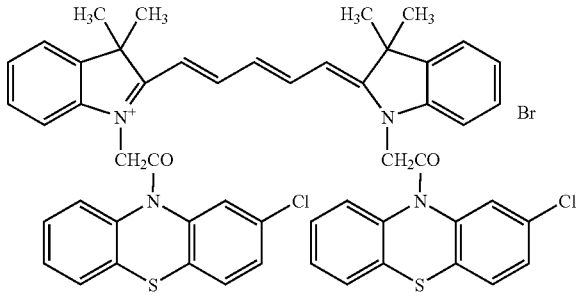

Blue Dye Compound - 1

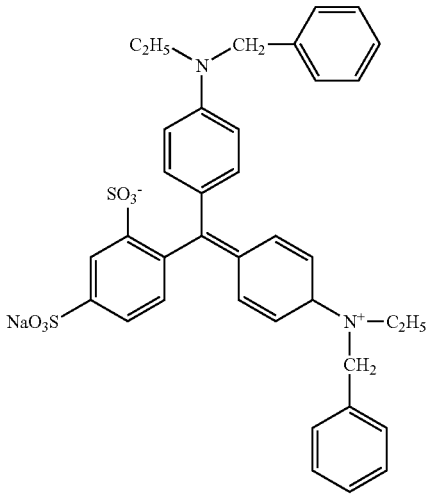

-continued

Yellow Dye Compound - 1

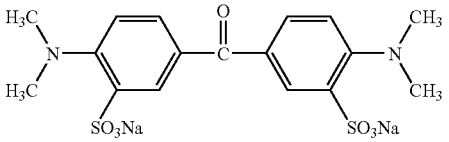

Reducing agent complex - 1

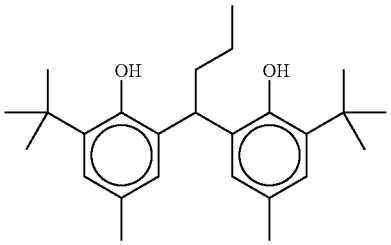

and

1:1 complex of

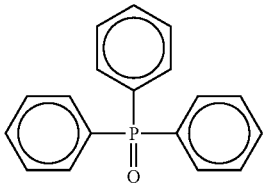

Reducing agent - 2

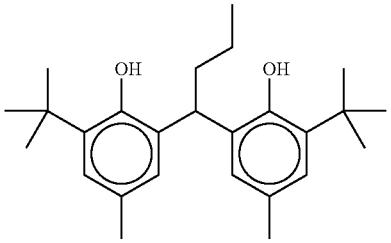

Hydrogen bonding compound - 1

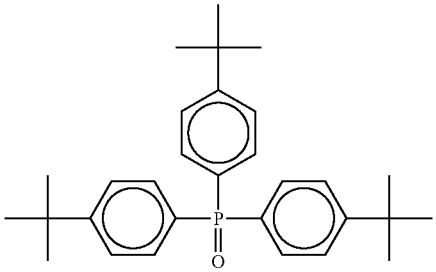

Polyhalogen compound - 1

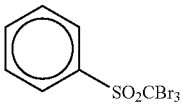

Polyhalogen compound - 2

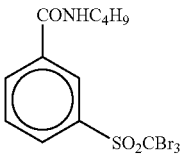

-continued

Mercapto compound - 1

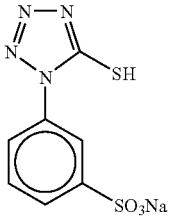

Mercapto compound - 2

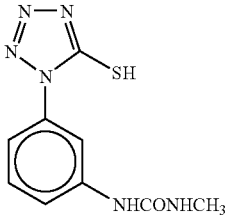

Phthalazine Compound - 1

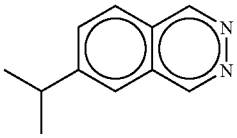

Developing Accelerator - 1

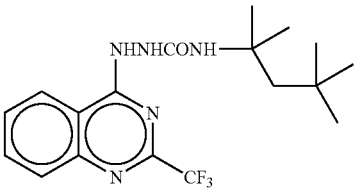

Developing Accelerator - 2

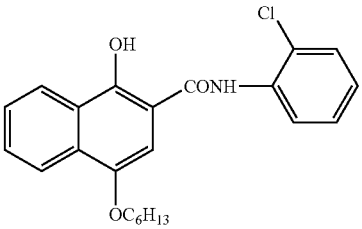

Color Tone Controlling Agent - 1

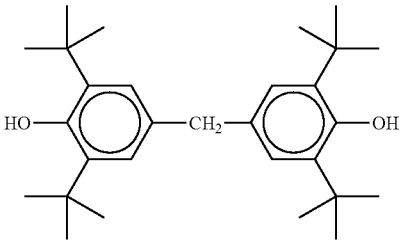

(F-1)

$CF_3(CF_2)_nCH_2CH_2SCH_2CH_2COOLi$

Mixtures wherein n represents from 5 to 11

(F-2)

$CF_3(CF_2)_nCH_2CH_2O(CH_2CH_2O)_mH$

Mixtures wherein n represents from 5 to 11 and m represents from 5 to 15

(F-3)

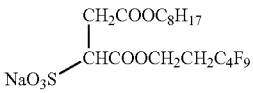

-continued (F-4)

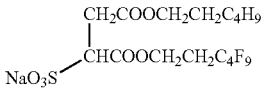

(Evaluation of Photographic Properties)

Each of thus-obtained samples was cut into pieces of a half-size, wrapped with a wrapping material mentioned below at 25° C. 50% RH, then stored for 2 weeks at ordinary temperature, and assessed according to the tests mentioned below.

(Wrapping Material)

The wrapping material used was 50 μm thick polyethylene film comprising 10 μm PET/12 μm PE/9 μm aluminum foil/15 μm Ny/50 μm polyethylene containing 3% carbon.

Oxygen transmittance was 0.02 ml/atm·$m^2$·25° C.·day; and moisture transmittance was 0.10 g/atm·$m^2$·25° C.·day.

Samples were exposed with Fuji Medical Dry Laser Imager FM-DP L (equipped with a 660 nm semiconductor laser having the maximum output of 60 mW (IIIB)) and, then, thermally developed (for 24 seconds in total with four plates of panel heaters respectively set at 112° C., 119° C., 121° C., and 121° C. for Photothermographic Materials-1 to -7 and for 14 seconds in total in the same manner for Photothermographic Materials-8 to -14). The resultant images were evaluated by means of a densitometer. The results are shown in Table 2.

Fog (Dmin): Transmission optical density in unexposed part

Sensitivity (ΔS): Sensitivity (S) is shown in terms of a reciprocal number of the exposure amount which provides the optical density of fog+1 and Sensitivity (ΔS) was shown in terms of a relative value provided the sensitivity of Sample 1 was set as 100. Each sample according to the invention showed an excellent result such that it had low fog while maintaining high sensitivity.

TABLE 2

| Sample No | Organic silver salt | Dmin | Sensitivity (ΔS) | Remark |
|---|---|---|---|---|
| 1 | Aa | 0.18 | 100 | Comparative Example |
| 2 | Ab | 0.18 | 100 | Comparative Example |
| 3 | Ac | 0.18 | 100 | Present invention |
| 4 | Ad | 0.18 | 100 | Present invention |
| 5 | Ae | 0.18 | 100 | Present invention |
| 6 | Af | 0.18 | 100 | Present invention |
| 7 | Ag | 0.20 | 100 | Comparative Example |
| 8 | Ba | 0.19 | 170 | Comparative Example |
| 9 | Bb | 0.19 | 170 | Comparative Example |
| 10 | Bc | 0.19 | 170 | Present invention |
| 11 | Bd | 0.19 | 170 | Present invention |
| 12 | Be | 0.19 | 170 | Present invention |
| 13 | Bf | 0.19 | 170 | Present invention |
| 14 | Bg | 0.22 | 170 | Comparative Example |

(Evaluation of Shelf-stability)

After the wrapped samples 1 to 12 thus obtained were stored under environmental conditions described below for 2 weeks, these samples were subjected to exposure and thermal treatments in a same manner as described above and, then, the photographic properties thereof were evaluated.

(1) In refrigerator (at about 10° C.)

(2) At 25° C.

(3) At 35° C.

(4) At 45° C.

The results are shown in Table 3. Samples according to the on were found to be excellent in shelf-stability.

TABLE 3

| Sample | Organic | Refrigeration | | 25° C. | | 35° C. | | 31/38 45° C. | | |
|---|---|---|---|---|---|---|---|---|---|---|
| No | silver salt | Dmin | ΔS | Dmin | ΔS | Dmin | ΔS | Dmin | Δs | Remark |
| 1 | Aa | 0.18 | 100 | 0.30 | 112 | 0.25 | 108 | 0.22 | 95 | Comparative Example |
| 2 | Ab | 0.18 | 100 | 0.22 | 112 | 0.25 | 108 | 0.2 | 95 | Comparative Example |
| 3 | Ac | 0.18 | 100 | 0.19 | 112 | 0.18 | 108 | 0.18 | 95 | Present invention |
| 4 | Ad | 0.18 | 100 | 0.18 | 112 | 0.18 | 108 | 0.18 | 95 | Present invention |
| 5 | Ae | 0.18 | 100 | 0.18 | 112 | 0.18 | 108 | 0.18 | 95 | Present invention |
| 6 | Af | 0.18 | 100 | 0.18 | 112 | 0.18 | 108 | 0.18 | 95 | Present invention |
| 7 | Ag | 0.20 | 100 | 0.24 | 112 | 0.29 | 108 | 0.18 | 95 | Comparative Example |
| 8 | Ba | 0.19 | 170 | 0.47 | 184 | 0.19 | 177 | 0.35 | 164 | Comparative Example |
| 9 | Bb | 0.19 | 170 | 0.33 | 184 | 0.19 | 177 | 0.27 | 164 | Comparative Example |
| 10 | Bc | 0.19 | 170 | 0.20 | 184 | 0.19 | 177 | 0.19 | 164 | Present invention |
| 11 | Bd | 0.19 | 170 | 0.19 | 184 | 0.19 | 177 | 0.19 | 164 | Present invention |

TABLE 3-continued

| Sample | Organic | Refrigeration | | 25° C. | | 35° C. | | 31/38 45° C. | | |
|---|---|---|---|---|---|---|---|---|---|---|
| No | silver salt | Dmin | ΔS | Dmin | ΔS | Dmin | ΔS | Dmin | Δs | Remark |
| 12 | Be | 0.19 | 170 | 0.20 | 184 | 0.19 | 177 | 0.19 | 164 | Present invention |
| 13 | Bf | 0.19 | 170 | 0.20 | 184 | 0.19 | 177 | 0.19 | 164 | Present invention |
| 14 | Bg | 0.22 | 170 | 0.41 | 184 | 0.37 | 177 | 0.19 | 164 | Comparative Example |

According to the invention, the photothermographic material which is low in fog and excellent in shelf-stability by using the organic silver salt which has been subjected to the annealing treatment can be provided.

What is claimed is:

1. A method of forming a photothermographic material comprising:

providing a photosensitive silver halide;

separately providing a non-photosensitive organic silver salt, the non-photosensitive organic silver salt being prepared from a reaction between an aqueous silver salt and an organic acid or an alkali metal salt thereof;

forming an aqueous dispersion of the non-photosensitive organic silver salt;

annealing the aqueous dispersion of the non-photosensitive organic silver salt by storing the aqueous dispersion of the non-photosensitive organic silver salt at a temperature between 30° C. and 90° C. for a length of time sufficient to improve the fogging property of a photothermographic material obtained comprising the non-photosensitive organic silver salt;

forming an emulsion comprising the photosensitive silver halide and the annealed aqueous dispersion of the non-photosensitive organic silver salt;

forming a water-base coating photothermographic material coating layer comprising the photosensitive silver halide, the annealed aqueous dispersion of the non-photosensitive organic silver salt, a reducing agent, and a binder; and coating a support with the photothermographic material coating layer comprising the photosensitive silver halide, the annealed aqueous dispersion of the non-photosensitive organic silver salt, the reducing agent, and the binder.

2. The method for forming a photothermographic material according to claim 1, wherein the annealing of the aqueous dispersion of the non-photosensitive organic silver salt is performed at a temperature between 30° C. and 60° C.

3. The method for forming a photothermographic material according to claim 1, wherein the annealing of the aqueous dispersion of the non-photothermographic material is performed for a period of time between 1 hour and 15 days.

4. The method for forming a photothermographic material according to claim 1, wherein the annealing of the aqueous dispersion of the non-photothermographic material is performed in a hermetically sealed container.

5. The method for forming a photothermographic material according to claim 4, wherein the hermetically sealed container is stored in a storage vault which is kept at 30° C. or more while a quantity of air and an area of interface between vapor and liquid phases therein are minimized.

6. The method for forming a photothermographic material according to claim 1 wherein the non-photosensitive organic silver salt contains from 50 mol % to 100 mol % of silver behenate.

7. The method for forming a photothermographic material according to claim 1 wherein the non-photosensitive organic silver salt is a silver salt of a long-chain aliphatic carboxylic acid having from 10 to 30 carbon atoms.

8. The method for forming a photothermographic material according to claim 1, wherein a particle size distribution of the non-photosensitive organic silver salt is a mono-dispersion.

9. The method for forming a photothermographic material according to claim 1, wherein the non-photosensitive organic silver salt is dispersed by a high-pressure homogenizer.

10. The method for forming a photothermographic material according to claim 1, wherein a developing accelerator is added to the photothermographic coating layer in an amount of 0.1% by mol to 20% by mol, based on an amount of the reducing agent.

11. The method for forming a photothermographic material according to claim 1, further comprising adding a fluorine-containing therein surfactant to the photothermographic coating layer.

12. The method for forming a photothermographic material according to claim 1, further comprising adding to the photothermographic coating layer a compound represented by the following formula (H) as an antifoggant:

$$Q\text{-}(Y)_n\text{—}C(Z_1)(Z_2)X \qquad \text{formula (H)}$$

wherein Q represents at least one group selected from the group consisting of an alkyl group, an aryl group, and a heterocyclic group; Y represents a divalent linking group; n represents 0 or 1; $Z_1$ and $Z_2$ each independently represent a halogen atom; and X represents a hydrogen atom or an electron-attracting group.

13. The method for forming a photothermographic material according to claim 1, wherein the reducing agent is a compound represented by the following formula (R):

Fomula (R)

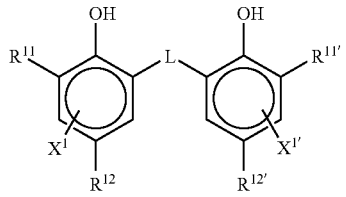

wherein $R^{11}$ and $R^{11'}$ each independently represent an alkyl group having from 1 to 20 carbon atoms; $R^{12}$ and $R^{12'}$ each independently represent a hydrogen atom or a substituent which can be substituted by a benzene ring; L represents —S— or $CHR^{13}$—, in which $R^{13}$ represents a hydrogen atom or an alkyl group having from 1 to 20 carbon atoms; and $X^1$ and $X^{1'}$ each independently represent a hydrogen atom or a group which can be substituted by a benzene ring.

14. The method for forming a photothermographic material according to claim 13, further comprising a non-reducible compound having a group which can form a hydrogen bond with an aromatic hydroxyl group of the reducing agent.

15. The method for forming a photothermographic material according to claim 1, further comprising forming a surface protection layer on the photothermographic material coating layer.

16. The method for forming a photothermographic material according to claim 1, wherein a total amount of silver in the photosensitive silver halide and the non-photosensitive organic silver salt in the photothermographic material coating layer is in a range of 0.1 $g/m^2$ to 5.0 $g/m^2$.

17. A method for forming a photothermographic material according to claim 1, wherein the annealing is performed while the dispersion contacts an atmospheric air.

* * * * *